United States Patent [19]

Newsome

[11] Patent Number: 4,771,896

[45] Date of Patent: Sep. 20, 1988

[54] APPARATUS FOR FORMING A RUNNING SHINGLE OF DOCUMENTS

[76] Inventor: John R. Newsome, R.R. #1, Box 58A, Shumway, Ill. 62461

[21] Appl. No.: 880,131

[22] Filed: Jun. 30, 1986

[51] Int. Cl.[4] ..... B65H 3/04

[52] U.S. Cl. ..... 271/3.1; 271/35; 271/94; 271/99

[58] Field of Search ..... 271/3.1, 35, 151, 94–99

[56] References Cited

U.S. PATENT DOCUMENTS

| | | | |
|---|---|---|---|
| 3,522,943 | 8/1970 | Swanson | 271/35 X |
| 3,973,768 | 8/1976 | Shannon | 271/99 |
| 4,046,369 | 9/1977 | Kluge | 271/151 X |
| 4,081,181 | 3/1978 | Crowe | 271/35 X |
| 4,361,317 | 11/1982 | Lapp-Emden | 271/3.1 |
| 4,456,241 | 6/1984 | Newsome | 271/11 |
| 4,463,942 | 8/1984 | Newsome | 271/12 |
| 4,526,359 | 7/1985 | Garavuso | 271/35 X |
| 4,555,101 | 11/1985 | Stobb | 271/35 X |

FOREIGN PATENT DOCUMENTS 2721987 11/1978 Fed. Rep. of Germany .

*Primary Examiner*—Richard A. Schacher
*Attorney, Agent, or Firm*—Leydig, Voit & Mayer

[57] ABSTRACT

Apparatus which takes stacks of pre-formed, stored printed signatures and forms them into a uniform shingle, running at extremely high velocity, for transport into a processing device such as a rotary trimmer or quarter folder. The apparatus, in certain major aspects, includes an input conveyor and a support table creating a vertical queue stack of signatures which is maintained at very low but essentially constant weight and height by photocell control of the speed of a conveyor which adds signatures to the top of the stack, a conveyor belt running beneath the bottom of the stack in a cut-out region of the stack-supporting table, with sequential vacuum clutching to the tail portions of successive signatures caused by spaced rows of holes extending across that belt and registerable with longitudinal slots in a vacuum shoe beneath the belt. As each row of holes reaches and runs along the slots, vacuum action clutches successive signatures to the belt, and the signatures are pushed at a constant rate seriatim from the bottom of the stack to exit in overlapped, shingled relation through a gate. The shingle setback is determined by the spacing between rows of holes in the belt, and the velocity of the exiting shingle may be varied by changing the belt drive speed without affecting the shingle setback.

46 Claims, 10 Drawing Sheets

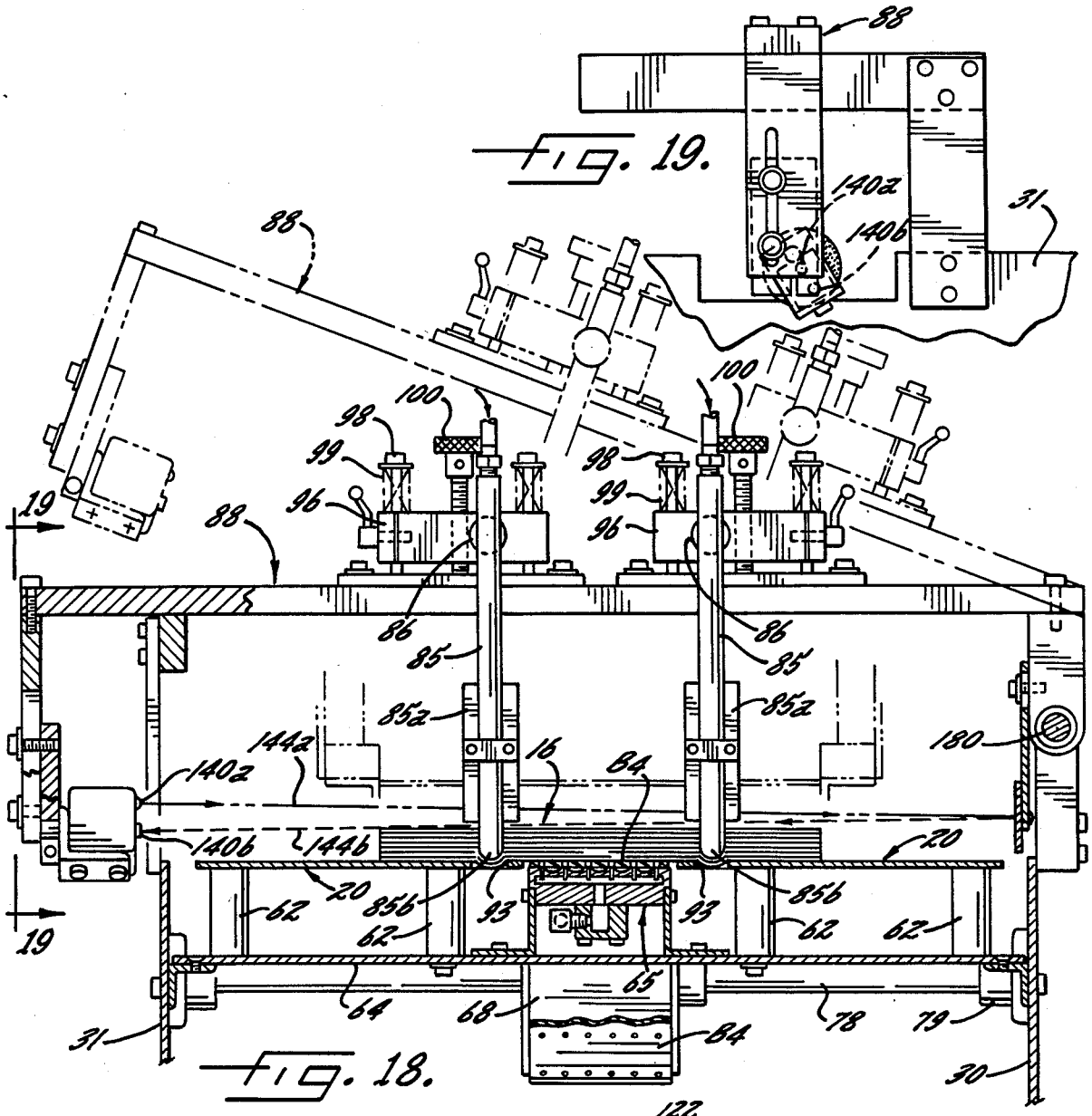
Fig. 19.
Fig. 18.
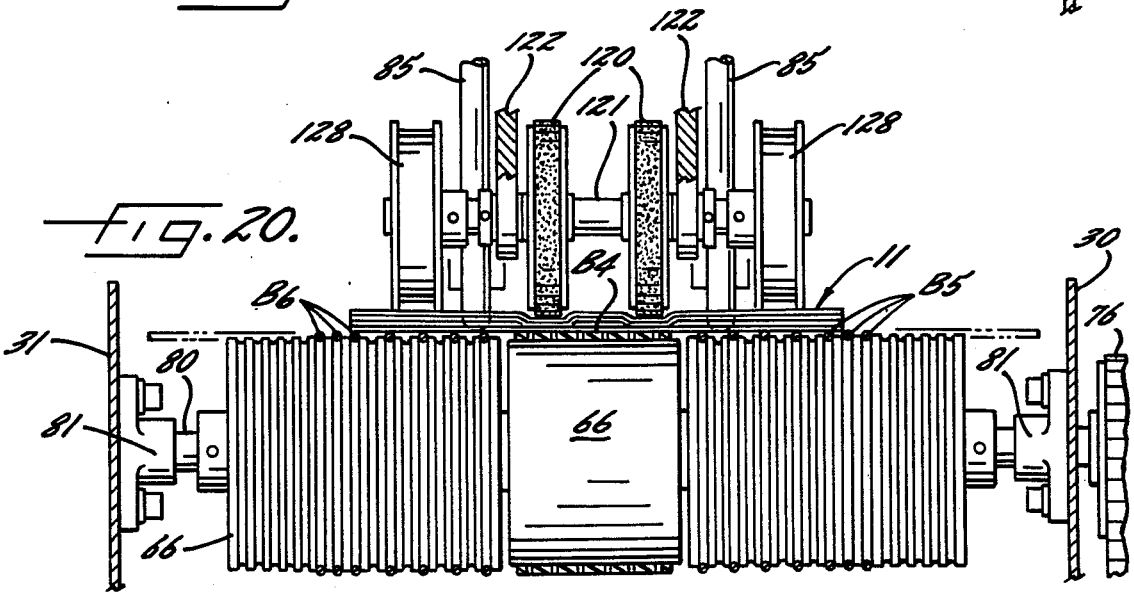
Fig. 20.

87
134
124
122
83
125
128
131
128
125
132
120
130
11
86
85
81
81
87
70
71
86
84
85
66
70
72
72
76
97
75
31
74
74a
30

APPARATUS FOR FORMING A RUNNING SHINGLE OF DOCUMENTS

BACKGROUND OF THE INVENTION

The present invention relates in general to apparatus for transporting paper signatures or the like into a processing device. More particularly, the invention pertains to forming a uniform running shingle of signatures traveling at high speed from signatures which have been preformed or which are somewhat randomly received from another machine or a storage area.

Newspaper and booklet presses conventionally include transport devices which bring out multiple sheet, folded assemblies in an overlapped running shingle. The assemblies are called "signatures" and their folded edges are called "spines". The signatures in a running shingle move with the spines as leading edges, and with each signature set back slightly (here called the shingle set back SSB) from the one that precedes it so that the shingle is constituted by overlapped signatures. If the set back from one leading edge (spine) to the next is one third of the length of a signature, for example, the shingle in total thickness is equal to three times the thickness of a single signature. In such a shingle moving on an underlying conveyor belt, the leading two-thirds of each signature rests on preceding signatures and only the trailing one-third is in contact with the belt.

Running shingles have been formed as a convenient way of transporting signatures from one location to another and into further processing devices such as quarter-folders (to make a double-folded signature), to labeling machines, to stackers, etc. As they come from a printing press, for example, the signatures are already in a shingle running at high speed and they may conveniently be fed into various processing devices.

For various reasons, however, the output of a printing press is often stored for subsequent processing. A primary reason is that the processing device simply runs more slowly than the press and cannot keep up; another reason is simply because production schedules may call for storing press output and mailing (or otherwise processing) at a later date. Some machines, including some printing presses, may produce signatures somewhat randomly rather than in a nicely formed running shingle. In any of these cases, the output of a signature-forming machine is converted into stacks for storage—and the stacks are later fed into a processing device of one kind or another.

Most processing devices (e.g., rotary trimmers or quarter-folders) accept as their input a running shingle of signatures. Thus, there is a need to convert preformed and stack-stored signatures (or randomly received signatures or a rough shingle) into a running shingle for in-feed into a processing device.

The present invention performs that function and, in one preferred embodiment to be described, handles multi-page, single-fold signatures of flexible newsprint paper. As will be apparent, however, the uses and advantages of the invention are not limited to paper nor even to folded signatures. On the contrary, essentially any item—which is reasonably flexible, which has a reasonably rigid leading edge (whether or not folded to constitute a "spine"), and which can be conveyed in overlapped relation as a shingle—may be accommodated by the present invention. Thus, for example, plastic sheets of reasonable thickness, cardboard sheets, or flat bags may be handled in the fashion to be described.

As a generic name for all such kinds of items, the term "document" will be here employed; it is to be understood that this is to be taken without regard to whether there is any printed matter on the item, whether the item is indeed folded so as to have a spine, or the particular material of which the item is constituted. The folded signatures treated in the following detailed description are simply an example of what is generically defined here as "documents".

There has been an historical problem of how to manipulate pre-stored or randomly received documents into a high-speed, uniform running shingle. The need for high running velocity is critical because some processing devices are capable of running at high speed —and if the shingle incoming to them is slow—their production capabilities are wasted. A uniform shingle is demanded for reliability of operation and avoidance of jams in a processing device.

OBJECTIVES OF THE INVENTION

It is the aim of the present invention to create from preformed and stored, or randomly received, documents a shingle which runs (is conveyed) at extremely high speed. A coordinate major objective is to make the set-back of the high-speed shingle reliably uniform.

Another object of the invention is to form a continuous shingle running at constant speed (and thus at a constant rate in terms of documents per minute) from documents that are supplied randomly (from pre-stored stacks, or a rough shingle) or even in batches, but at an average rate equal to the constant rate. A coordinate objective is to provide apparatus for accomplishing the foregoing and yet which enables the constant speed or velocity of the uniform shingle to be adjusted so as to match the speed of any downstream processing device, but wherein a change in such velocity does not make any change in the shingle setback.

It is a further object to bring to the art an effective and high speed apparatus for clutching successive documents of a stack to an underlying conveyor so they are stripped from the bottom of the stack seriatim, with each being started in motion before the preceding one has traveled sufficiently to clear the stack, thereby to create a shingle.

Still another object is to provide reliability of the stripping action by keeping the stack of approximately constant weight (or height)—so that conditions of friction and the needed clutching force remain essentially constant at all times.

And it is a detailed but important object of the invention to provide a document-clutching conveyor belt which runs at extremely high speed over an underlying surface but which is nevertheless rendered immune from both (i) destructive heat due to rubbing friction, and (ii) prohibitively rapid wear.

BRIEF DESCRIPTION OF THE DRAWINGS

These and other objects of the invention will become apparent as the following detailed description proceeds in conjunction with the accompanying drawings, in which:

FIG. 18 is a vertical elevation, partially in section, taken substantially along the line 18—18 in FIG. 2 and showing, inter alia, means for sensing the height of a queue stack;

FIG. 19 is a fragmentary detail side view taken substantially along the line 19—19 in FIG. 18;

FIG. 20 is a vertical elevation, partially in section, taken substantially along the offset line 20—20 in FIG. 2;

Although the invention has been shown and will be described in some detail with reference to a preferred embodiment as an example and one which deals with conventional folded paper signatures, there is no intention that the invention thus be limited to such detail nor to the handling of folded paper signatures. On the contrary, it is intended here to cover all modifications, alternative embodiments, and equivalents, (including those for handling what has been defined generically as documents) which fall within the spirit and scope of the invention as defined by the appended claims.

DETAILED DESCRIPTION OF THE PREFERRED EMBODIMENT

1. Introductory Overview

Figure 3:
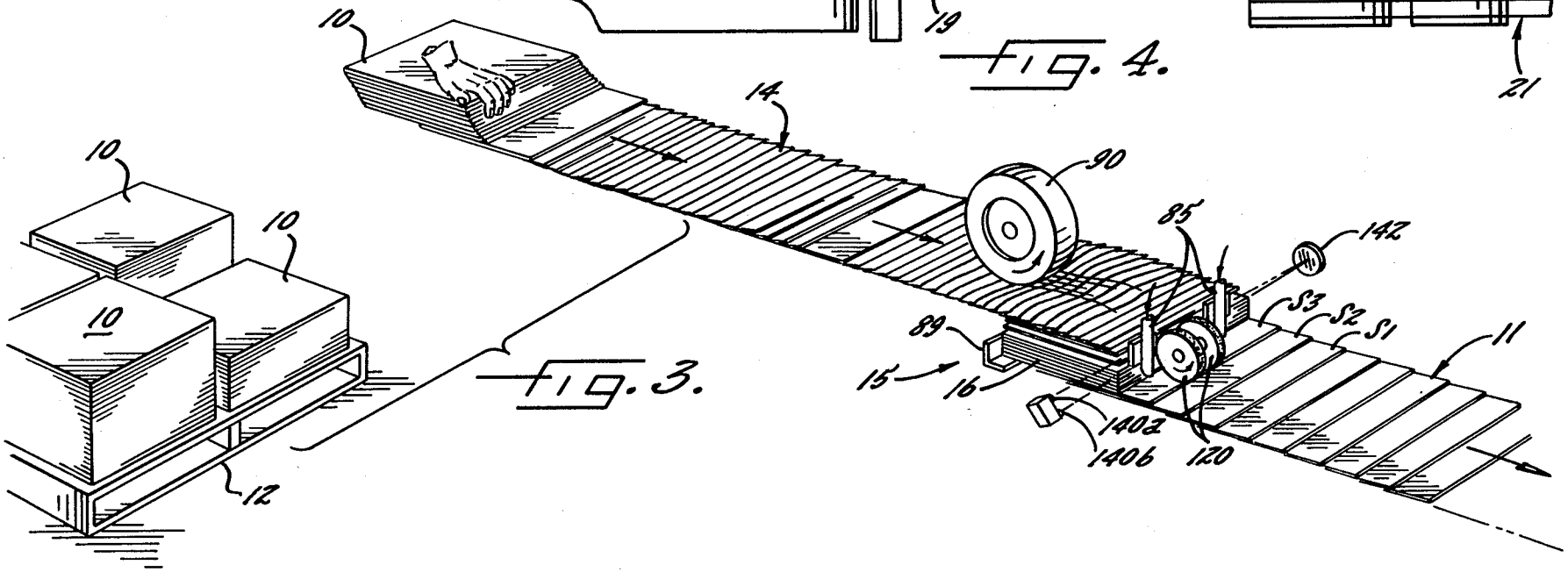
FIG. 3 is a diagrammatic perspective illustration of such apparatus in simplified form and illustrating the manipulative sequences to which the documents or signatures are subjected.

Referring first to FIG. 3, the apparatus of the present invention as here to be described is intended to convert pre-formed and stored stacks 10 of multipage, single-fold newsprint signatures into a high-speed, uniform, running shingle 11 which exits in a downstream direction (toward the right). The stacks 10 of signatures may be held on pallets 12 or the like in a storage area, and a human operator places successive ones of such stacks on a first conveyor means (to be described) located generally in the left portion of FIG. 3. As the human operator places a stack 10 of signatures on the flat surface of the moving first conveyor, he spreads the vertically stacked, individual signatures rearwardly into a rough shingle 14 so that it travels downstream toward a holding location 15 at which a vertical queue stack 16 is formed. The human operator need not spread out a stack 10 of signatures with any great care, and the running shingle 14 may be established by spreading to produce non-uniform setback of the leading edge spines of individual signatures by amounts which vary somewhat. Preferably, the settack in the rough shingle 14 is generally on the order of one-half inch.

As will be detailed below, the holding location 15 is constituted by a planar support surface, spaced vertically below the plane of the first conveyor, and upon which successive signatures are vertically piled in the queue stack 16. For this purpose, the leading edges of the rough shingle signatures are moved up against one or more transversely spaced members which form a substantially vertical barrier or stop overlying cut-out slots or channels in the support surface. Disposed in association with the support surface is a second conveyor means for periodically stripping off successive signatures from the bottom of the stack so that they are started downstream to exit beneath the lower tips of the stop members and thence travel as the uniform shingle 11. At the right end of the diagrammatic illustration in FIG. 3, there is a third conveyor which receives the shingle 11 from the second and continues the transport at high speed (e.g., 500 f.p.m.).

Figures 1, 2:
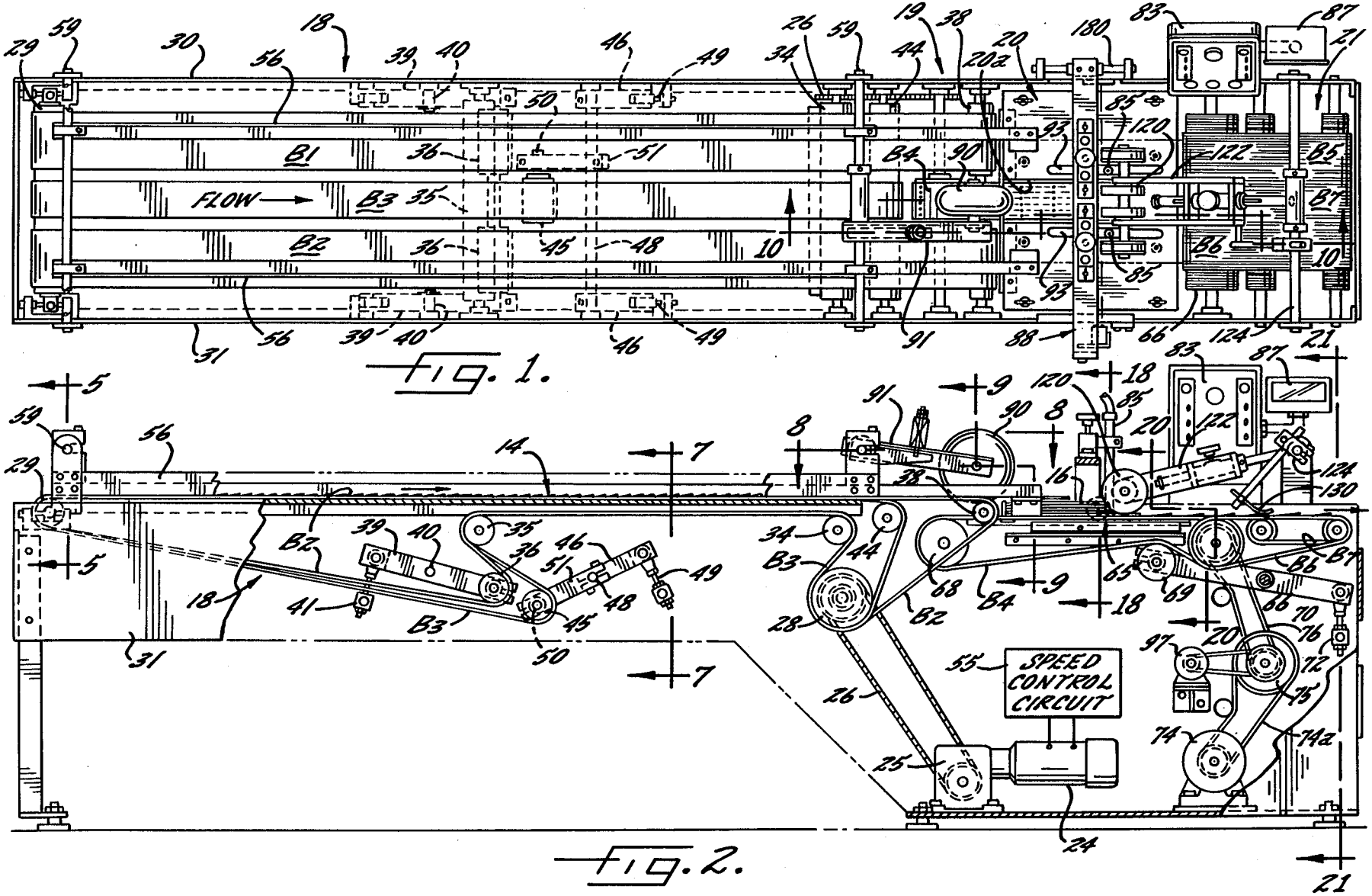
FIG. 1 is a plan view of apparatus embodying the invention and operating to form documents into a uniform, high-speed running shingle.
FIG. 2 is a diagrammatic side elevation (with a side frame member removed) of the apparatus appearing in FIG. 1.

Turning next to FIGS. 1 and 2, the rough shingle 14 is illustrated only in the latter figure to provide better clarity in FIG. 1. In general terms, the first conveyor means 18 is disposed in an elongated region at the left, the second conveyor means 19 is located in the region of a support surface 20, and the third conveyor means 21 is located at the extreme right to receive the shingle 11 as it leaves the second conveyor and its associated clutching arrangement. The flow of signatures is generally to the right (called "downstream") in FIGS. 1 and 2, and the uniform shingle 11 exiting at high velocity toward the right proceeds into any desired processing device (not shown) located at the right end of the apparatus in FIGS. 1 and 2.

2. Organization of First Conveyor

As shown particularly in FIGS. 1, 2 and 5–7, the first conveyor (upon which stacks 10 of signatures are loaded by a human operator and spread into a rough shingle) comprises two outer belts Bl, B2 and an inner belt B3—the upper flights of which all reside more or less in a common plane and travel in a downstream direction. The right end of the inner belt B3 terminates at a downstream location adjacent to a driven, running belt B4 which forms the second conveyor means, this termination being upstream from the downstream end of the outer belts B1, B2 thereby forming an "interdigital" relation of the first and second conveyors. The downstream ends of the outer belts B1, B2 are adjacent the support surface 20 at the holding location.

Figure 6:
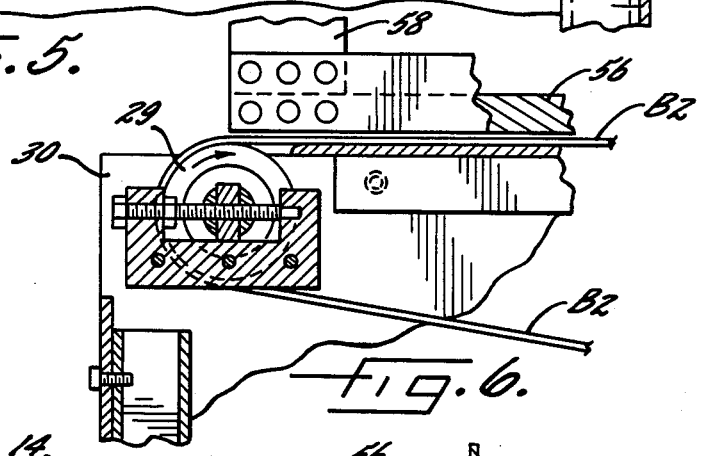
FIG. 6 is a detail sectional view taken substantially along the line 6—6 in FIG. 5.
Figure 7:
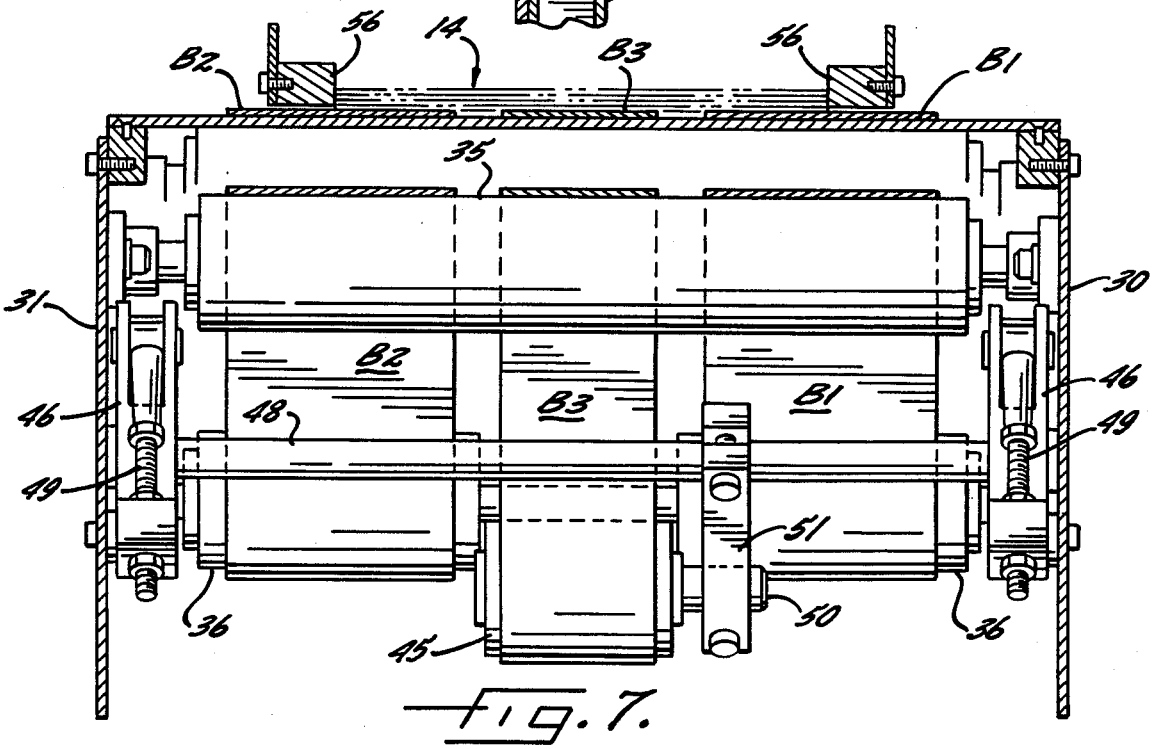
FIG. 7 is an enlarged, fragmentary sectional view taken substantially along the line 7—7 in FIG. 2.

As best seen in FIG. 2, the first conveyor belts B1, B2, B3 are all driven at a common, variable speed by a motor 24 coupled through a gearbox 25 to a chain 26 which drives a common transverse sheave 28 in a clockwise direction. Flat surface sheaves exemplified by the right-end sheave 29 (see FIG. 5) are disposed transversely of the shingle flow path and suitably journaled for support on machine side frames 30, 31. It will be apparent that the right-end sheave 29 carries all three belts B1, B2, B3 and defines the essentially horizontal plane in which their upper flights run downstream to the right as viewed in FIGS. 1 and 2. Other than at the common drive sheave 28 and the right-end sheave 29, the outer belts and the inner belts follow somewhat different closed paths. In more detail with reference to FIG. 2, the two outer belts B1 and B2 are trained over idler sheaves 34, 35, 36 and a right-end sheave 38. The sheave 36 is carried on tension arms 39 rockable about a pivot 40 by linkages 41 adjustable in length to permit establishing a desired degree of belt tension. The right-end sheave 38 with the left-end sheave 29 define the horizontal plane in which the upper flights of the belts B1, B2 run, and preferably these belts are arranged to rub lightly upon and be vertically supported by an underlying plate 42 (FIGS. 6 and 7).

In slight contrast, the inner or middle belt B3 is trained over not only the left-end pulley 29 but also over sheaves 44, 34, 35 and 45 (FIG. 2), the latter being carried on arms 46 fixed to a pivot rod 48 rockable in response to adjustment of longitudinally adjustable tensioning rods 49. As seen in FIG. 7, the tensioning idler 45 is journaled on a stub shaft 50 carried by a depending arm 51 fixed to the pivot rod 48 and angularly indexable to adjust tension when the threaded, extensible rods 49 are adjusted in length. It may be noted that the sheave 38 defines the end of the upper flight of the outer belts B1, B2, whereas the sheave 44 defines the right end of the upper flight of the inner belt B3.

The first conveyor drive motor 24 is of a variable speed type and its speed is controlled by a control circuit 55 in a manner to be described below. It will be apparent, nevertheless, that all three belts B1, B2, B3 of the first conveyor run at the same lineal speed and are driven from a common motor 24.

Figure 5:
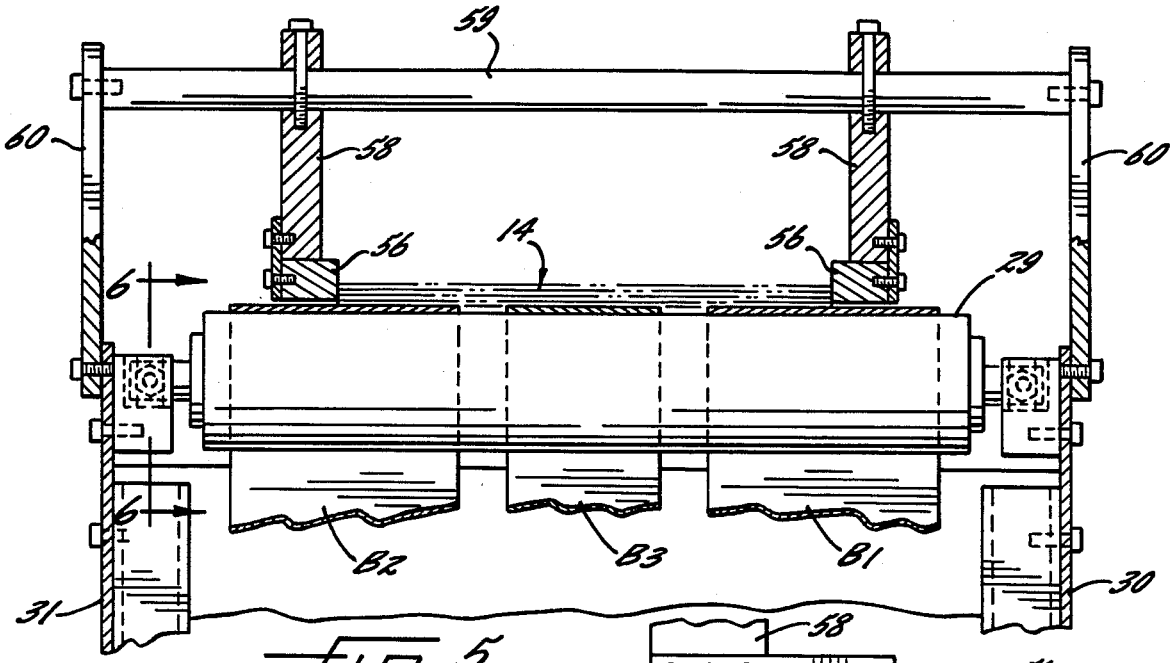
FIG. 5 is an enlarged, fragmentary section taken substantially, along the line 5—5 in FIG. 2.

As best seen in FIG. 5, side guides 56 in the form of elongated bars with inner flat surfaces are arranged to guide the rough shingle 14 as it proceeds with the first conveyor means along the flow path. The guides 56 are suspended by hanger rods 58 which depend from cross rails 59 extending between brackets 60 upstanding from the side frames 30, 31. The side guides 56 are adjustable (at the time of set-up for a given job) in a direction transverse to the flow path in order to accommodate signatures or documents of different widths, it being only necessary to loosen holding bolts associated with the hangers to adjust the side guides into the desired positions straddling the center line of the flow path. The belts B1 and B2 run beneath the side guides 56 as will be apparent from FIGS. 1 and 5.

3. Organization of Second Conveyor and Clutching Means

Figure 8:
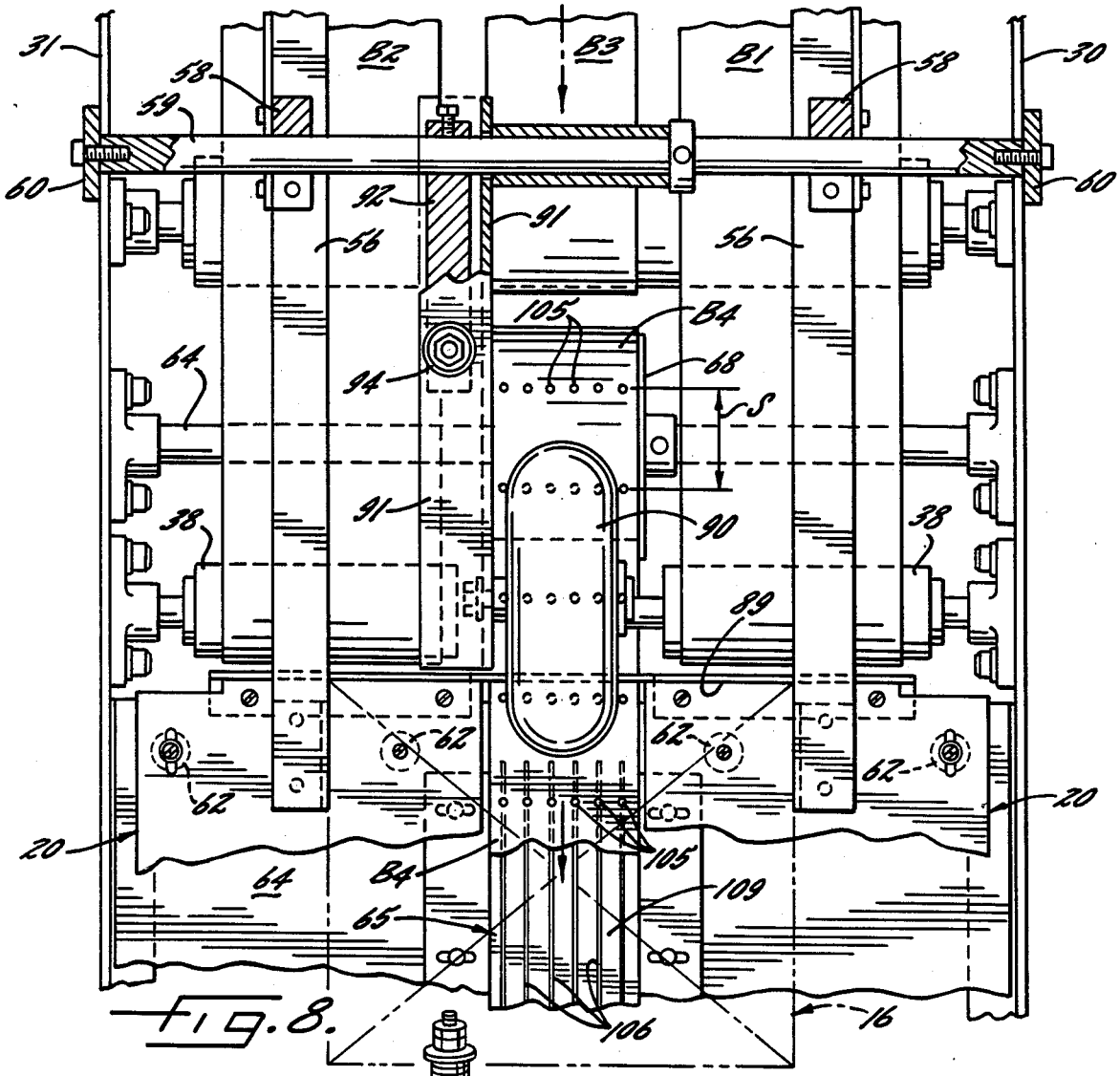
FIG. 8 is an enlarged, partial plan view, partially in section, taken substantially along the offset line 8—8 in FIG. 2.
Figure 9:
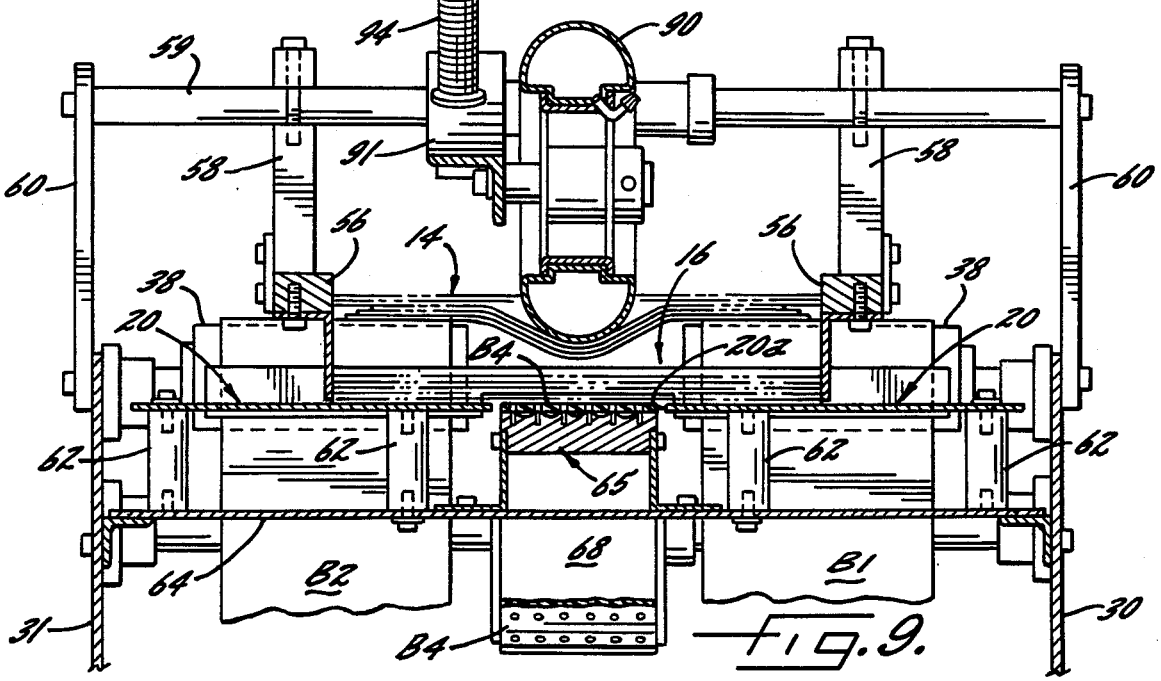
FIG. 9 is an enlarged vertical section taken substantially along the offset line 9—9 in FIG. 2.

As seen best in FIGS. 1 and 9, the support surface 20 (sometimes herein called a "table") is constituted by two smoothly finished flat metal plates separated in the transverse medial region of the flow path so as to leave a lengthwise cut-out region 20*a* in which the upper flight of the belt B4 is disposed. The two metal plates which form the support surface 20 are carried by spacers 62 extending upwardly from a cross bracket 64 between the two side frames 30, 31. The upper flight of the conveyor belt B4 runs in a downstream direction in superimposed relation to the upper, smooth surface of a vacuum shoe or plenum 65. One sees from FIG. 2 that the second conveyor belt B4 (sometimes hereinafter called the "vacuum clutch belt") is trained over sheaves 66, 68 and a tensioning sheave 69, the latter being carried by arms 70 rockable about a pivot 71 in response to theaded adjustment in the length of tensioning links 72. Mechanical drive to make the upper flight of the belt B4 run in a downstream direction comes from a motor 74 via a drive belt 74*a* to a speed-decreasing pulley 75 and a belt 76 trained over and imparting rotational drive to the sheave 66. The sheave 68 is carried by a shaft 78 journaled in bearings 79 supported on the side frames (FIGS. 8 and 18), this sheave being of limited width matching the width of the belt B4 which is disposed in the medial cut-out 20*a* of the table 20. On the other hand, the drive sheave 66 is carried on a shaft 80 journaled in bearings 81 (FIG. 20) carried by the side frames 30, 31 and this sheave 66 has a central smooth surface over which the belt B4 is trained. It may be mentioned in passing that the sheave 66 serves also as the drive sheave for the third conveyor to be described later.

As noted below, the motor 74 is manually adjustable (by speed control circuits, not shown) in order that the uniform shingle 11 runs at a linear velocity matched to the requirement of any processing device. For this purpose, an operator's start-up and control box 83 (FIG. 2) is mounted near the downstream end of the belt B4. It includes a speed-setting potentiometer for the motor 74 and is associated with a digital read-out 87 which displays the linear speed of the belt B4 in feet per minute (f.p.m.) as derived from the output of a tachometer 97.

FIGS. 9 and 18 show that the support surface 20 and the upper flight of the belt B4 are disposed essentially in coplanar relation. Preferably, however, the upper surface of the belt B4 is about 50 mils below the support surface 20 to avoid or lessen rubbing contact between the belt and the lowest, non-moving signature in the queue stack 16. As seen in FIGS. 2 and 9, the support surface 20 lies in a plane which is spaced vertically below the upper flight of the first conveyor belts B1, B2. This arrangement is in accordance with one feature of the present invention by which the first conveyor in part forms means for piling successive signatures of the incoming rough shingle 14 onto the top of the vertical queue stack 16.

Figures 10, 13:
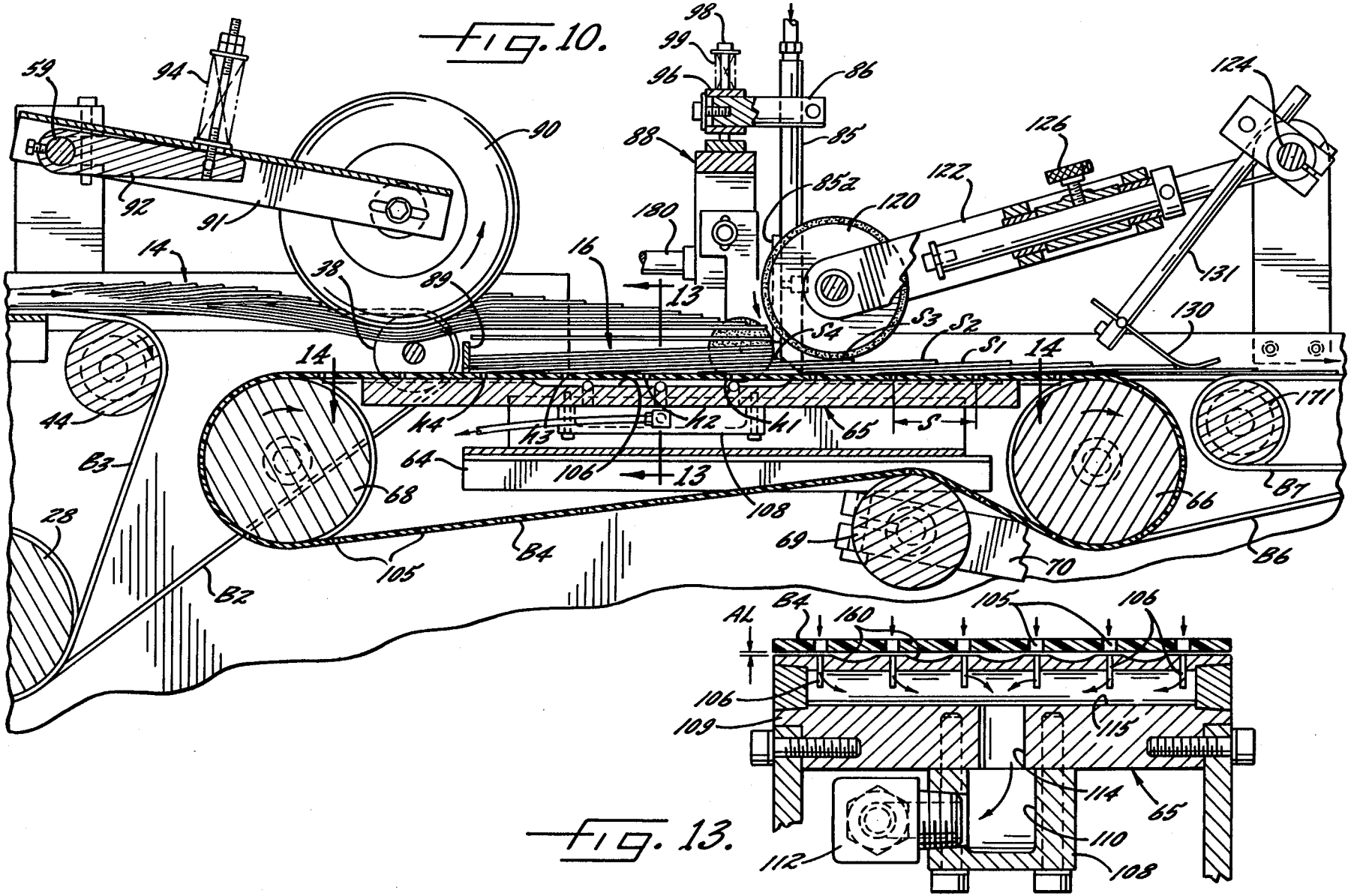
FIG. 10 is an enlarged, fragmentary vertical section taken substantially along the offset line 10—10 in FIG. 1.
FIG. 13 is an enlarged section taken substantially along the line 13—13 in FIG. 10 and showing details of a vacuum clutching arrangement.

Referring to FIGS. 1 and 10, a barrier or stop means is associated with the support surface 20, and in locations transversely straddling the belt B4 and cut-out region 20*a* as apparent from FIG. 18, such stop means in the present instance being formed by two vertical air tubes 85 rigidly depending from horizontal arms 86 extending from a cross bridge 88 (the bridge being visible in FIGS. 1 and 18). Each of the stop tubes 85 carries a flat plate 85*a* on its upstream side and located such that signatures of the rough shingle flowing inwardly will have their leading edges strike those plates, thereupon to fall vertically downward so as to create the vertical queue stack 16. A thin upstanding plate at the upstream edge of the support surface 20 forms a rear retainer 89 to collect the upstream edges of each signature as its leading edge strikes the stop means and that signature falls downwardly onto the queue stack 16.

To enhance the reliability with which successive signatures of the shingle 14 are deposited upon the top of the queue stack, means are provided to stiffen those signatures as they depart from the belt B3 and are more or less "hurled" toward the stop plates 85*a* by the outer belts B1, B2 with which they remain in contact. In accordance with one aspect of the present invention such stiffening means are constituted in part by a large, soft idler wheel 90—preferably formed by a softly inflated inner tube of the sort use in garden tractor tires. From FIG. 10, one sees that the lower periphery of the stiffening wheel 90 is disposed slightly below the plane of the belt B3 and downstream from that belt. As the rough shingle leaves the belt B3 (but continues to be carried by the outer belts B1, B2), the stiffening wheel 90 catches the leading edges of those signatures in their transverse medial regions and bends them downwardly so as to form a "rib". As so stiffened, each of the signatures in the shingle 14 thus is enabled to continue its forward movement without "drooping" even after its trailing edge leaves the belts B1, B2 and until the leading edge contacts the stop means formed by the tubes 85 and the plates 85*a*. The stiffening wheel 90 is carried at the end of an arm 91 (FIG. 10) having freedom to pivot about the crossbar 59. A limit dog 92 is, however, rigidly fixed to extend forwardly from the crossbar 59 and to be engaged by the arm 91 so as to define the lowermost position to which the wheel 90 may move under its own weight. If incoming signatures of the shingle 14 tend, however, to jam up beneath the stiffening wheel 90, the latter has freedom to rise as the arm 91 rocks counterclockwise against the downward biasing action of a spring 94.

There are thus a number of structural features which all contribute to or aid in the reliable transfer of individual signatures incoming in the shingle 14 into a vertical queue stack 16. First, it is desirable that the support surface 20 and the second conveyor belt B4 lie beneath the queue stack at the holding location which is determined by the stop tubes and stop plates 85, 85*a*. For this reason, the inner belt B3 is foreshortened relative to the outer belts B1, B2 and the second conveyor belt B4 is extended into an interdigital relation with and between the belts B1, B2. Secondly, because the support surface 20 is located slightly downstream from the downstream ends of the belts B1, B2 and the stop or barrier means 85, 85*a* are located even further downstream, the stiffening wheel 90 imparts a bowing or ribbing to the incoming shingle 14 so that the individual signatures are stiffened and retain their leading edges elevated above the queue stack until they have been projected (by drive of the belts B1, B2) sufficiently that their leading edges strike the stop or barrier. This assures that as each signature within the incoming shingle 14 hits the stop means, it falls vertically downwardly onto the queue stack 16 with its trailing edge just forwardly of the retainer 89 (see FIG. 10).

In accordance with an important feature of the present invention, the stop means which terminate forward movement from the shingle 14 are disposed in a generally perpendicular relation to the plane of the support surface 20 and the belt B4, but such stop means at a lower tip or tips are in registry with elongated slots or channels 93 cut in the support surface 20, the stop tips thereby forming a gate through which successive signatures exit (as explained below) when clutched to the second conveyor belt B4. As shown best in FIGS. 10, 11, llA and 18 the lower tips 85*b* of the stop tubes 85 are located vertically just at the level of the support surface 20 or such that they project downwardly into the channels a slight amount (e.g., one-eighth inch). The tube tip vertical location is significant in creating proper formation of the uniform shingle which is desired. It is adjustable from job-to-job if the signatures being handled are of different thicknesses or lengths—the tips being lower for thin, relatively flexible signatures, and slightly higher for thicker, relatively stiffer signatures. For such adjustability, the arms 86 which carry the stop tubes 85 extend from crossbars 96 slidable on pins 98 projecting upwardly from the bridge 88. The crossbars are biased downwardly by springs 99 (FIG. 18) to a position which is determined by adjustment of stop screws 100 threaded into the bars and engageable at their lower tips with the bridge 88. Thus one may see from FIG. 18 that turning the adjustment screws 100 will raise or lower the stop tubes 85 and thus determine the vertical location of the lower tips 85*b* in the channels 93.

Figure 4:
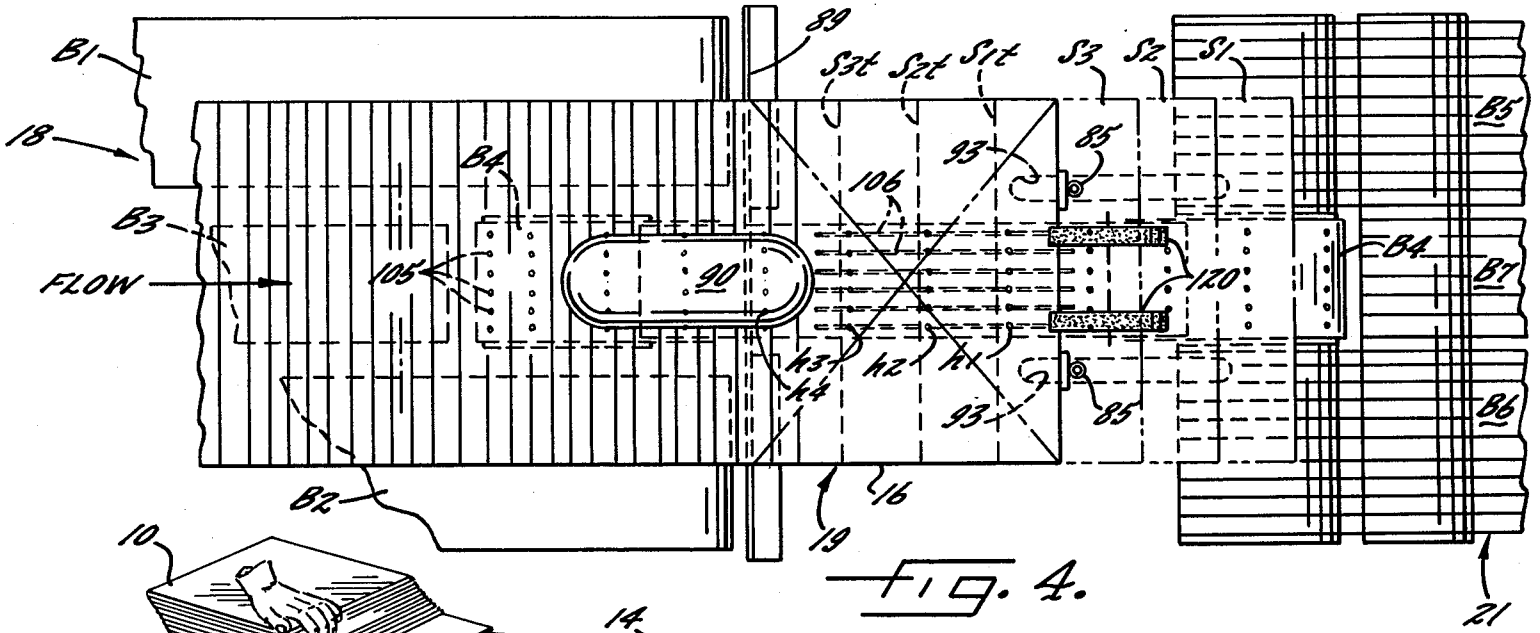
FIG. 4 is an enlarged and diagrammatic plan view corresponding to a portion of FIG. 1.
Figure 11:
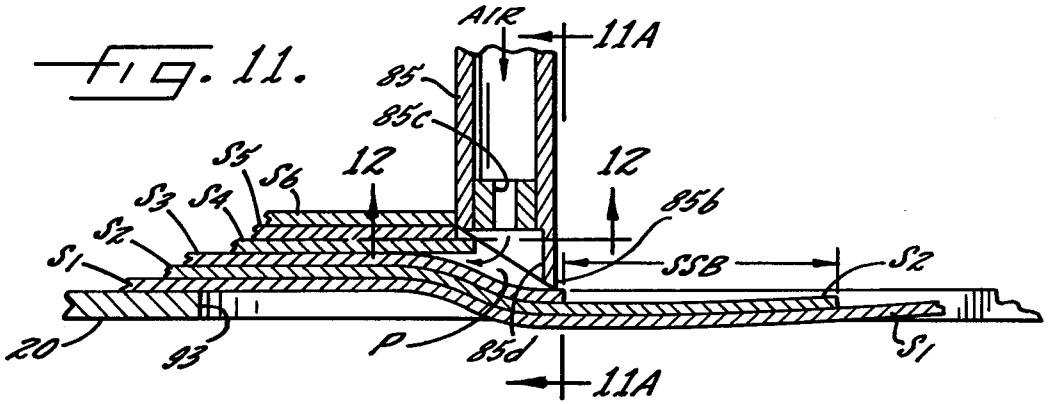
FIG. 11 is a fragmentary detail section, corresponding to a portion of FIG. 10, illustrating certain details of a document barrier or stop and also directing a lubricating stream of air toward the leading edges of some documents in a queue stack.
Figure 11A:
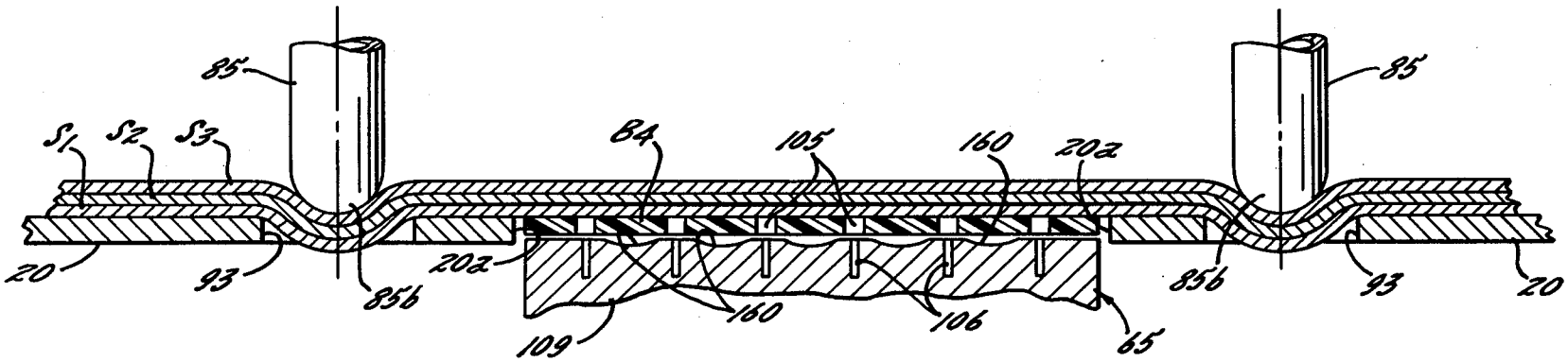
FIG. 11A is a fragmentary vertical section, non-rigorous in nature, taken substantially along the line 11A—11A in FIG. 11.

As may be seen from FIGS. 1 and 4 and 11A, the two channels 93 in the surface 20 underlie the stop tubes 85 and extend both upstream and downstream from such tubes. As a typical but non-limiting example, if the tubes 85 are $\frac{5}{8}''$ in diameter, the two channels 93 may be made one inch wide, extend about three inches upstream from the tubes, and about eight inches downstream beyond the tubes.

At this point, the reader will understand that the apparatus according to a preferred embodiment of the invention includes means for transporting preformed and stored signatures as an incoming rough shingle to bring them successively to the top of a holding stack or queue 16 which rests upon a planar support surface 20 having the second transport belt B4 disposed in a cutout region 20*a* of that surface and slightly below that surface. In accordance with a further and important feature of the present invention, means are provided to strip successive signatures seriatim from the bottom of that queue stack so that they are carried downstream, in succession and staggered or shingled relationship, through a gate formed by the tube tips 85*b* and the channels 93.

For this purpose and in the preferred form, the belt B4 is manufactured with a plurality of longitudinally spaced, apertured or otherwise air-permeable regions through which air may be sucked in order to attract the contiguous undersurface of a signature and thereby drivingly clutch that signature for forward movement with the belt. More particularly, the belt B4 is manufactured with a plurality of rows of apertures or holes 105 punched therethrough, the row constituting discrete air-permeable regions and being separated longitudinally of the belt with a predetermined spacing S which corresponds to the desired setback in the final, uniform shingle. Thus, there are non-permeable regions intervening between the spaced, permeable regions constituted by the rows of holes 105. Underlying the upper flight of the belt B4 is the vacuum shoe 65. For the moment, it may be assumed that the upper surface of the shoe 65 is smooth and that the upper flight of the belt B4 rides in contact with it. The vacuum shoe is formed with a plurality of longitudinal slots 106 spaced transversely of the flow path such that the respective holes 105 within a row each move over and in alignment with one of those slots. Means are provided to create a vacuum within the shoe so as to suck air through the slots and through any holes 105 which are aligned with and moving along those slots. It will be apparent that the slots 106 underlie the upper flight of belt B4 and form means for drawing suction through those rows of holes 105 which are located within the moving upper flight above the slots 106.

Although different specific arrangements for the vacuums shoe and plenum may be adopted, an example is illustrated in FIGS. 13–17. As there shown, a cup-like member 108 is bolted to the underside of a flat plate 109 to define a chamber 110 to which vacuum is applied from a vacuum pump (not shown) via a conduit 111 and a fitting 112. The chamber 110 communicates via three vertical holes 114 with transverse passages 115 drilled across the plate 109 and plugged at their opposite extremities. Each of the three passages 115 extends through all of the slots 106 so that air may be drawn by the vacuum pump downwardly through the upper opening of each slot, into the cross passages 115, thence downwardly through the holes 14 and outwardly from the chamber 110 through the conduit 111. In a word, there is suction applied at all times to and through the lengthwise slots 106 in the vacuum shoe 65. As each row of holes 105 in the upper flight of belt B4 is traversing the slots 106, therefore, vacuum or suction is applied through that row of holes and will attract the contiguous undersurface the tail portion of a signature down into driven or clutched engagement with the belt. Therefore, as each row of holes 105 reaches the upstream end of the slots 106, the upstream portion or tail portion of a signature in the queue stack will be clutched to the belt and caused to advance forwardl.y with the belt. This clutched engagement of the tail portion of a signature to the belt B4 is removed at a later instant when that row of holes moves beyond the downstream end of the slots 106.

In accordance with the present invention, however, the weight of the queue stack 16 is controlled and limited so that until a row of holes 10 reaches the vacuum slots 106, the belt B4 may slide or slip relative to the contiguous undersurface of the tail portion of the lowest non-moving signature in the queue stack. Because of this, a given signature at the bottom of the queue stack is not moved forwardly with the belt when the preceding signature begins to move. Rather, that given signature remains stationary until such time as the preceding signature has moved a distance equal to the spacing S between successive rows of holes 105. Thus, successive signatures are started seratim and pushed forwardly through the gate (beneath the tube tips 85*b* with the leading edge of each signature trailing that of the preceding signature by a shingle setback SSB equal to the spacing S.

One beauty of this arrangement is that the setback SSB of the shingle 11 exiting from the gap, as documents are stripped successively from the underside of the queue stack, is not dependent upon the speed of the belt B4. The drive motor 74 for the belt B4 may be adjusted over a consderable range (depending upon the necessary speed of a shingle entering the processing device) without affecting the shingle setback. Reliable clutching action has been obtained, for example, when the belt speed was varied over a range from about 550 f.p.m. to as low as 10 f.p.m. On the other hand, the shingle setback may be easily changed by substituting for the belt B4 another belt with a different spacing S between successive rows of holes 105.

This action of successively clutching signatures from the bottom of the queue stack 16, so that they are pushed seriatim through the gate beneath the stop tubes 85 and in shingled relationship, may perhaps best be understood from inspection of FIGS. 4, 10, 11 and 11A. The number will be different for signatures of different lengths and thickness and for different values of the chosen setback SSB, but in the present embodiment, three moving signatures may be disposed in and passing through the gate at any given time. Those three signatures in the exiting shingle 11 are identified as sl, s2, and s3, with their trailing edges identified in FIG. 4 by phantom lines $s1_t$, $s2_t$, and $s3_t$. It may be seen that the signature s1 is clutched to the belt B4 by that row of holes labeled h1, whereas the shingle s2 is clutched to the belt by the holes h2, and the signature s3 is clutched to the belt by the holes h3. Those three signatures are all moving through the gate (FIGS. 11 and llA) beneath the tube tips 85*b* simultaneously, but they were started forwardly by pushing action at successively spaced instants in time so that the leading edge of each one precedes the trailing one by a shingle setback SSB equal to the spacing S between successive rows of holes. As will be apparent, the signature s3 most recently started into forward motion by clutching action of the row of holes h3 is being pushed, because the undersurface portion of signature s3, forward of the tail portion, is masked from vacuum clutching to the preceding row of holes h2 by the intervening tail portion of the preceding signature s2. The masking prevents the signature s3 from being pulled forward. Also apparent from FIGS. 10 and 11 is the fact that the next and still non-moving signature s4 has its leading edge still engaged with the lower tip 85*b* of the stop tube 85, and the moving belt B4 is sliding relative to the tail portion of that signature because the next row of holes h4 has not yet reached the slots 106. When holes h4 reach the upstream end of the slots 106, then the leading edge of the signature s4 is cammed downwardly by the tube tip 85*b* and dimpled downwardly into the channel 93 (FIG. llA) as it moves forwardly when the tail portion of that signature is clutched to the belt at holes s4 and driven forwardly.

As is apparent from FIG. 11, the lower end or tip 85*b* each stop tube 85 is tapered, i.e., inclined downwardly in the downstream direction. To some extent, this "cams" a portion of the leading edge of a signature downwardly into the channel 93 as it begins to move through the gate in response to forward drive when clutching occurs at the tail portion of that signature. In effect, there is a running "dimple" (FIG. llA) in three superimposed signatures just in the transverse regions of the tube tips 85*a* and the elongated channels 93. It is to be observed from FIG. 11 that just after the leading edge of the last-clutched signature s3 has been pushed and cammed beneath the tube tip 85*b* (further depressing and dimpling the signatures sl and s2), the leading edge of the stationary signature s4 is abutted against the inclined surface of the tube tip and has not yet been cammed downwardly. The lowered leading edge of signature s3 forms a pocket P with the succeeding leading edge of s4.

Figure 12:
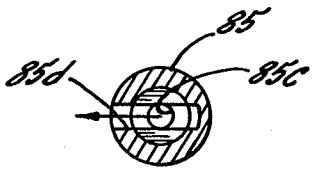
FIG. 12 is a detail view taken substantially along the line 12—12 in FIG. 11.

In accordance with another aspect of the invention, means are provided to lessen friction between adjacent signatures in the lower portion of the queue stack 16. Such means take the form of an arrangement for blowing air inwardly toward the leading edge of the lowest non-moving signature in the stack 16 which is still in abutment with the tube tip 85*b* and still held essentially stationary. The stop tubes 85 are hollow as illustrated in FIGS. 10–12. Compressed air (from a source not shown) is fed therethrough to a restric:tor 85*c* where it is guided to exit in an upstream direction through a slit nozzle 85*d* (FIG. 12) so as to flow into the pocket P and between (i) the upper surface of the last-clutched signature s3, and (ii) the bottom surface of the stationary next signature s4. This inflowing air has a lubricating action and lessens the sliding friction between the adjacent signatures. Thus, as the signature labeled s3 in FIG. 11 is moving forwardly through the gap, the sliding friction which it experiences relative to the next signature s4 is lessened, and the stripping action is rendered more reliable.

In accordance with another desirable feature, the stop means or members (here formed by the air tubes 85) are tapered in a downstream direction at their lower extremities. (See FIG. 11). The taper is straight as illustrated in FIG. 11 but a rounded or bullet nose shape has been found to be equally successful. Whereas the signatures labeled s5 and s6 in FIG. 11 are abutted up against the vertical upstream side of the tube 85, the signature s4 has been able to slide slightly forward due to the light rubbing friction and the motion of the signature s3. By the provision of this tapered tip for the stop member, each signature is held and prevented from exiting through the gate until its tail portion is affirmatively clutched by the action of the holes 105 and the slots 106, but the signatures are enabled to take on a slightly staggered relationship prior to the time that the next one (s4) is clutched and positively pushed forwardly through the gap. This assures that the signature s4 will indeed have its leading edge cammed downwardly and dimpled by the rounded tube tip when it is clutched (slightly later) to the belt B4.

A further feature adds to the reliability with which the uniform shingle 11 is pushed from the bottom of the queue stack 16. As each signature begins exiting through the gap with its leading edge portion in rubbing contact with the rounded lower tip 85*b* of the stop tubes 85, and there may be a tendency for that leading edge portion to curl upwardly. To inhibit such curling, a "tucking and holding" means is provided to retain the leading edge of an exiting signature in a downward position firmly contacting the underlying signature. As here shown best in FIGS. 10, 20 and 21, such "tucking and holding" means take the form of two rollers 120 overlying the shingle 11 immediately downstream of the gate and biased downwardly (as by their own weight). Preferably these rollers have soft and resilient (e.g., sponge rubber) peripheries. These rollers 120 overlie the belt B4 and are journaled for rotation on a cross shaft 121 carried at the extremity of a rocker arm 122 pivoted to swing about the axis of a transverse shaft 124 supported between arms 125 upstanding from the side frames. The rocker arm is adjustable in length due to the presence of two telescoping portions and a locking screw 126, so that the upstream/downstream location of the rollers 120 may be changed according to the types and thicknesses of the signatures being handled. The rollers 120 actually extend upstream beyond the stop means or tubes 85 (see FIG. 10) but their peripheries at the upstream side clear the queue stack 16. They serve a significant secondary function in that the leading edge of a signature projected toward the stack by the first conveyor is "knocked down" by the rollers 120 if it comes in too high or with an upward curl. Just downstream of the tips 85*b* of the stop tubes 85, the peripheries of the rollers 120 at the bottom are slightly higher than the tips 85*b* (see FIG. 10) and thus if the leading edge of an exiting signature tends to curl up as it moves just downstream of the tips 85*b*, then the clockwise rotating peripheries of the wheels 120 will catch it and tuck it down. This is the primary function of the rollers 120. Also carried at the outboard ends of the shaft 121 are two rimmed metal wheels 128 which ride on the transverse extremities of the exiting shingle 11 to hold the individual signatures downwardly in contact with one another. The rocker arm 122 and the wheels 120, 128 are biased downwardly by their own weight and have freedom to swing slightly as each leading edge passes beneath those wheels.

Figure 21:
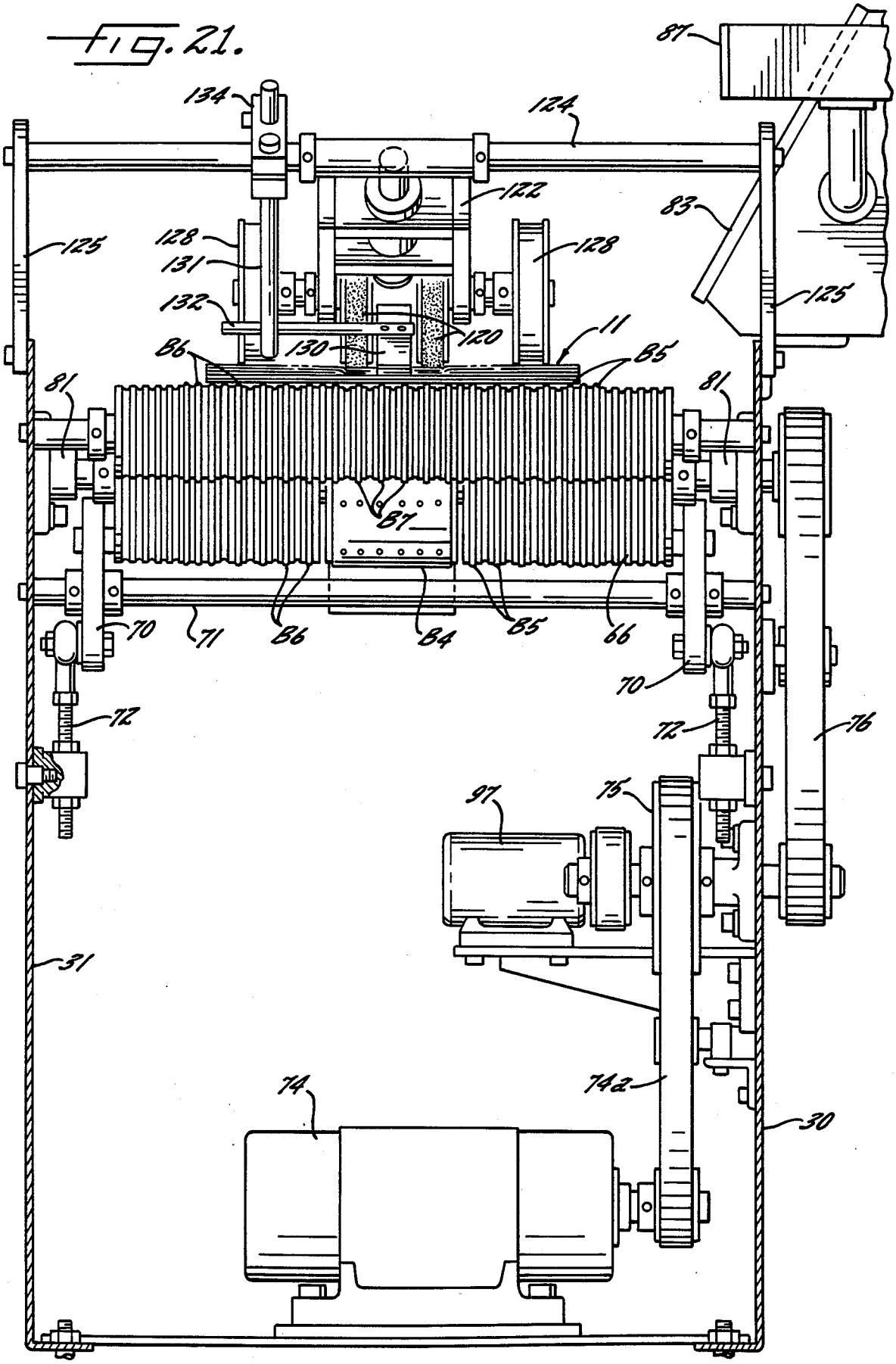
FIG. 21 is a vertical elevation, partially in section, taken substantially along the line 21—21 in FIG. 2.

Finally, as a further means of stabilizing the running shingle 11, a spring finger 130 is disposed to ride on the upper surface of that shingle just at the point where it exits from the belt B4, i.e., just downstream of the sheave 66 (FIG. 10). The spring finger 130 is carried at a transverse location intermediate the soft tucking wheels 120. As shown in FIG. 21, the spring finger depends from a rod 132 extending transversely of the flow path from the arm 131, and the latter arm is held by a clamp 134 on the rod 124 so as to be adjustable in angular position.

In carrying out the invention in its preferred aspects, means are provided for maintaining the weight of the queue stack 16 relatively low and at least approximately constant. This secures the benefits of keeping the friction resistance to relative horizontal sliding (which must take place in the lower region of the stack 16) not only quite low but also essentially uniform for consistency in the successive clutching and stripping of signatures.

Relative sliding (inevitably with at least some friction) must occur between the lowermost signatures (see s1, s2, s3 which are moving as illustrated in FIG. 11) and the support surface 20 on either side of the belt B4. Relative sliding also occurs between the belt B4 and the lowest un-clutched signature (see s4 in FIG. 10) which still abuts the stop, until the next row of holes 105 reaches the clutch point (i.e., the upstream end of slots 106). Still further, relative sliding must occur between two signatures, i.e., the one most recently clutched to the belt B4 and the next one above it which is still stationary (note from FIG. 10 that the upper surface of s3 is sliding relative to the contacting under surface of s4). The frictional resistance force in all these cases is a monotonic function of vertical force, i.e., the weight of the higher signatures in the stack 16. By keeping this frictional resistance low—and importantly, essentially constant—the clutching action is not only aided but made consistent in the sense that each successive signature is given essentially the same acceleration (and the same rate of change of acceleration) with the same time lag from the instant that a row of holes 105 just arrives at the upstream ends of the slots 106. This makes the shingle setbacks (that is, the spacing from the leading edge of each signature to the leading edge of that which precedes it) more consistent and uniform.

In accordance with this aspect of the invention, means are provided to sense the weight of the queue stack 16 and to speed up or slow down the first conveyor when the weight tends to fall below or rise above a predetermined value. In this way, the stack height is increased if the weight tends to fall below a predetermined, desired value or it is decreased if the weight tends to increase above such value. While direct weight-sensing elements (e.g., load cells in the support surface 20) may be employed, the weight is sensed indirectly in the present embodiment by sensing the height of the queue stack. Because the signatures being handled for any given job will be essentially of equal weight and vertical thickness (but may differ from job-to-job), the weight of the queue stack will be essentially proportional to its height. Accordingly, photoelectric height-sensing and control means (next to be described) are employed, but certainly other specific weight-responsive arrangements may be adopted.

To sense the height of the stack 16, a sharply focused light beam source 140*a* and a receiving photocell 140*b* are mounted on a bracket 141 depending from the bridge 88 (FIG. 18) and aligned with a reflector or mirror 142 on the opposite side frame 30. This creates closely spaced upper and lower light beams 144*a*, 144*b* which extend transversely across the machine just upstream of the stop means 85 where they may be broken or completed depending upon the height of the stack 16. Any of a wide variety of known control circuits may be associated with the photocell 140*b* so as to increase the speed of the first conveyor drive motor 24 if the intensity of receiving light exceeds a first threshold (stack height lower than a predetermined value), or so as to decrease the speed of that motor if such intensity is less than a second threshold (stack height greater than a predetermined value).

Figure 22:
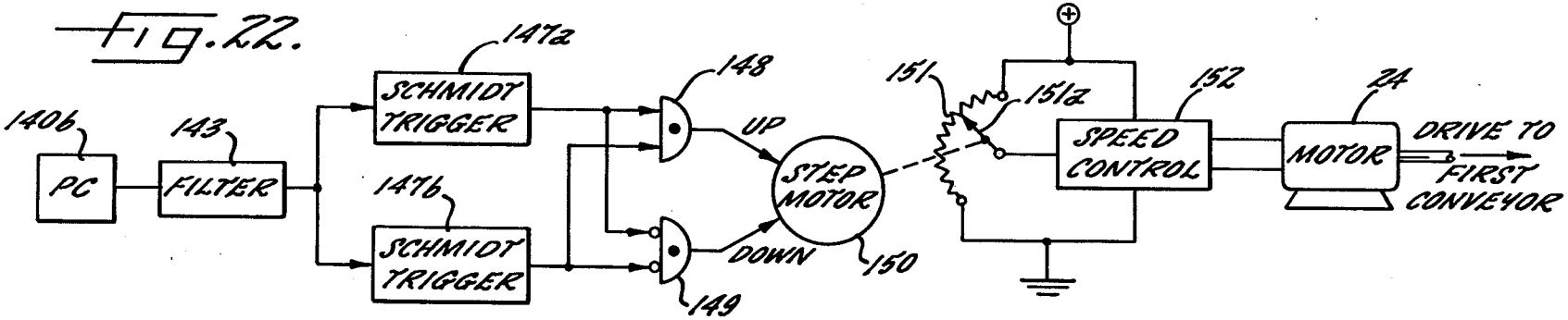
FIG. 22 is a schematic block diagram of circuitry for controlling the speed of a first conveyor so as to keep the weight (or height) of a queue stack approximately at a predetermined value.

One suitable speed control circuit 55 (not necessarily that employed commercially) is illustrated in FIG. 22 simply to make clear the principle of operation. As there shown, the photocell and its associated internal circuitry produces an output voltage which progressively increases as the stack height progressively decreases from a first, high value at which the beam 144*b* is totally blocked to a second, lower value at which the beam 144*b* is wholly unattenuated. The photocell output is passed through a filter 143 (to eliminate the short effect of successive signatures falling downwardly on the stack from conveyors B1, B2, B3) to a pair of Schmidt trigger circuits 147*a*, 147*b* which respectively produce logic "1" voltage outputs only when the photocell voltage (i) exceeds a first threshold $T_1$ corresponding to a first stack height $H_1$ less than that at which the light beam is fully attenuated, and the stack is "too high"; and (ii) exceeds a second threshold $T_2$ greater than $T_1$ but less than that at which the light beam is of full intensity, and the stack is "two low". The two Schmidt trigger circuit ouputs are applied both to an AND gate 48 and a NOR gate 149 whose output terminals lead to the UP and DOWN energization terminals of a step motor 50. The step motor is drivingly connected to reposition the wiper 151*a* of a potentiometer 151 which supplies a variable control voltage to a control unit 152 coupled to energize the first conveyor drive motor 24. It will be seen from FIG. 22 that if a stack height (and weight) are lower than a first predetermined value and both trigger circuits produce a logic "1" output, the AND gate 148 produces a logic 1 voltage on the UP terminal of the step motor 150 so that the wiper 151*a* is driven in a direction to increase the controlling voltage applied to the speed control unit 152, thereby increasing the speed of the conveyor drive motor 124. This means that if the stack height (and weight) decreases below a first predetermined value, the first conveyor is speeded up so that signatures in the rough shingle 14 are brought in faster to the queue stack 16—thereby causing its height to increase. Conversely, if both the trigger circuits 147*a*, *b* produce logic "0" outputs because the stack height has increased above the desired value, then the output of the NOR gate goes to a logic 1 voltage and the step motor 150 is energized to drive the wiper 151*a* in a direction to decrease the control voltage applied to the speed unit 152. In this fashion, the speed of the conveyor drive motor 24 is decreased and the signatures of the rough shingle 14 are fed to the queue stack at a lower rate until the height of the stack is reduced to within a predetermined range. Thus, the height and weight of the queue stack is maintained within a very narrow range so as to provide the low, essentially constant rubbing friction mentioned above.

When the machine is called upon, for a different job, to handle signatures of a different thickness and individual weight, then the light source and photocell 140*a*, 140*b* may be adjusted vertically so as to reset the predetermined height at which the queue stack will be maintained. This adjustability is illustrated in FIG. 19 which makes it plain that the photocell support member 155 may be vertically adjusted by virtue of the slot 157 formed in the bracket 141.

Figures 14, 15, 16, 17:
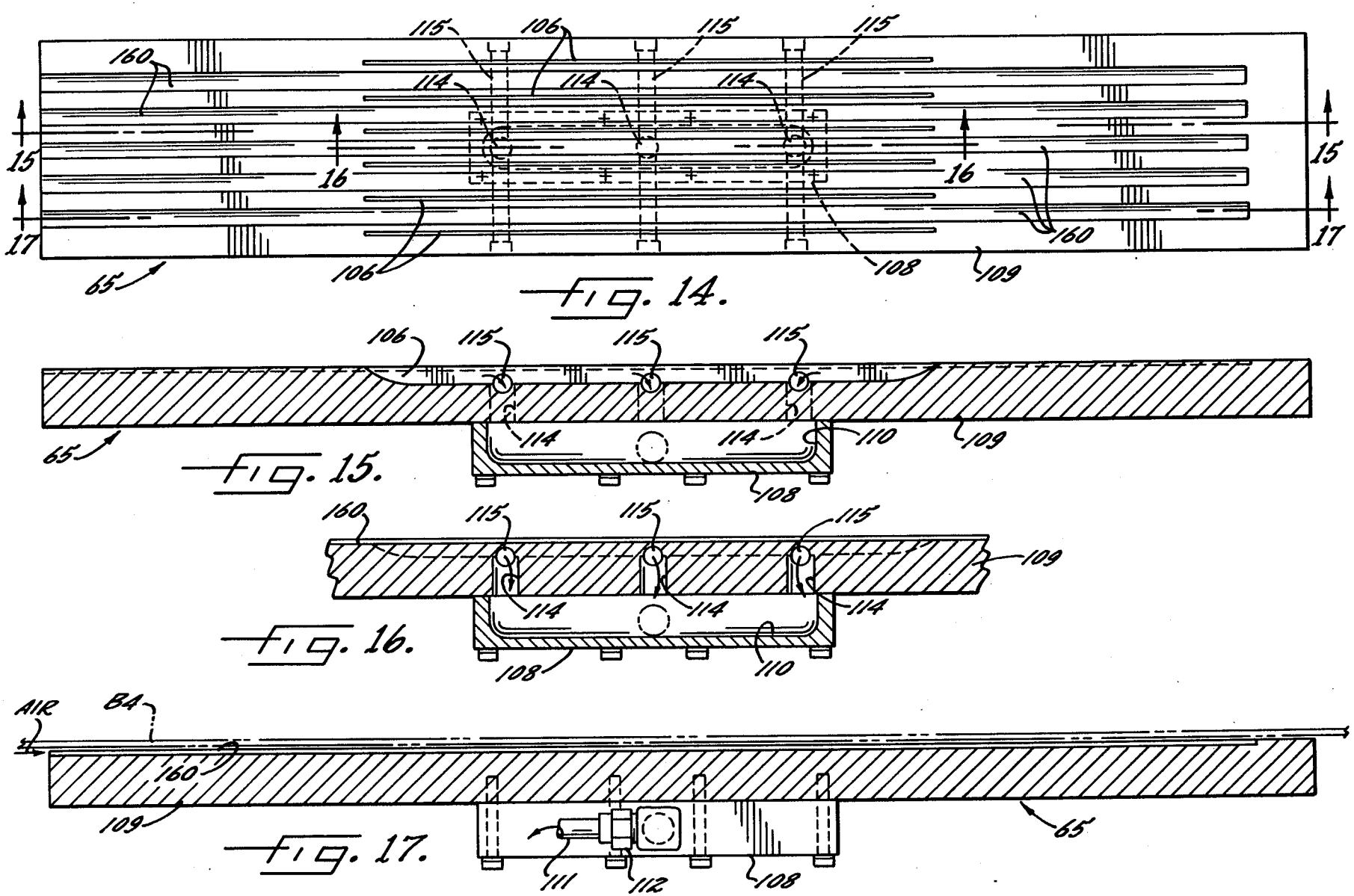
FIG. 14 is a plan view, taken substantially along the line 14—14 in FIG. 10, of a vacuum shoe with slots and grooves therein.
FIGS. 15, 16 and 17 are vertical section views taken respectively along the lines 15—15, 16—16 and 17—17 in FIG. 14.

In the development of a commercial embodiment of the present invention, a major problem was encountered due to the extremely high speed with which the clutching belt B4 was running in sliding contact with the upper surface of the vacuum shoe 65. It was found that rubbing friction between that metal surface and the under surface of the belt flight generated so much heat that the belt was literally burned up or eroded away within a relatively short period of usage. A solution to that problem was found by providing means to create a thin layer of air between the under surface of the belt B4 and the upper surface of the vacuum shoe 65 so as to "lubricate" their adjacent surfaces and indeed to maintain them with very slight spacing that does not detract from the vacuum clutching action produced by the holes 105 and the slots 106. As shown best in FIG. 13, this is achieved by creating irregularities in the otherwise generally flat upper surface of the vacuum shoe 65; as here shown, elongated concave troughs 160 are milled out so as to be parallel to and disposed between the slots 106. As indicated in FIG. 14, these troughs 160 extend essentially over the entire length of the metal plate 109, beginning at its extreme upstream end but each trough terminates short of the downstream end in some type of barrier (closed wall or restriction) which inhibits escape of air in the direction of belt travel. Here, each trough is simply closed at its downstream end. Thus, each trough as viewed in FIG. 13 has an air entry port at the left end of the plate as viewed in FIG. 14. With the belt B4 traveling at a high lineal speed, air is drawn into each of the troughs 160 by laminar attachment to the belt surface, but such air is in effect "squeezed" as it moves toward the closed right ends of the troughs. This acts somewhat in a fashion analogous to an air compressor and results in a thin layer of air being squeezed laterally from the sides of each trough and beneath those regions of the belt B4 which otherwise would be running on the upper, flat surface portions of the plate 109. This thin air layer is illustrated at AL in FIG. 13 and provides means to lubricate and to separate the adjacent surfaces of the belt B4 and the vacuum shoe so that rubbing friction and heat are essentially eliminated. It will be understood, of course, that suitable means other than the troughs 160 may be adopted to establish this air lubrication which has been found important in one commercial embodiment of the invention.

4. Organization of the Third Conveyor

As mentioned above, when a given signature has been clutched by vacuum action to the running second conveyor belt B4, the driving connection ceases when the appropriate row of holes moves downstream beyond the ends of the slots 106 (see FIGS. 1 and 10). By this time, however, the leading portion of that particular signature, i.e., the one which has just been de-clutched, will have been moved downstream to overlie two sets of conveyor belts B5 and B6 which have their upstream ends straddling the downstream end of the belt B4 in an interdigital relationship. Disposed immediately downstream of the conveyor belt B4 is a third set of conveyor belts B7 which also receive and then begin to transport the uniform, high-speed shingle 11 as it reaches that point. The conveyor belts B5, B6, B7 are all constituted as a plurality of side-by-side "O-ring" cross section belts which run in small individual grooves of their associated sheaves. Moreover, these sheaves and those sets of circular cross section belts are driven by the same motor 74 and at the same speed as the belt B4 so that they are enabled to pick up and continue transport of the running shingle 11 into some appropriate processing device (not shown).

In greater detail, FIG. 2 shows that the belts B5 and B6 are trained over the sheave 66 which is driven from the motor 74 and which, in its central region, drives the belt B4. These belts B5, B6 run in grooves formed in the outboard regions of a downstream sheave 170, the belts B7 being located in grooves in the central region of this particular sheave. The upstream portions of the belts B7 run in the grooves of a sheave 171 so that all of the circular cross section belts B5, B6, B7 have their upper flights located in co-planar relationship to the belt B4, are driven by the same motor 74, and therefore run at the same lineal speed as the belt B4. The use of transversely spaced individual belts of circular cross section is desirable because with a plurality of grooves formed in the sheaves 66, 170, 171, these belts may be relocated in their transverse positions to accommodate signatures of different widths which may be handled during the processing of different jobs on the machine. It will be understood, of course, that the third conveyor means which serves to receive the running shingle 11 from the clutching belt B4, and to continue the transport of the running shingle 11, may take any of a variety of specific configurations which may be selected as a matter of choice by those skilled in the art. Indeed, one may choose to make the clutching belt B4 considerably greater in length and to associate its downstream portion with straddling belts running at a synchronous speed, although for reasons of economy or cost it is desirable simply to transfer the running shingle from the clutching belt B4 to a third conveyor formed by means such as the belts B5, B6, B7.

As an ancillary feature of the present apparatus, the bridge 88, which serves as the primary support for the stop tubes 85 and their plates 85*a*, as well as for the photocell unit 140*a*, 140*b*, is mounted on the machine frames in a fashion so that it can be swung to an upper, open position (see FIG. 18) for purposes of servicing or adjustment—and to clear out crumpled signatures in the event of undesirable jamming. For this purpose, the bridge 88 is mounted at the frame 130 on a pivot rod 180 so that when retaining means (not shown) associated with the frame 31 are released, the entire bridge may be swung upwardly to that position shown by phantom lines in FIG. 18. It should be noted also from FIG. 1 that the elongated pivot rod 180 permits the entire bridge 88 to be adjusted in position upstream or downstream relative to the support surface 20. This adjustability enables the apparatus to be modified so as to accommodate signatures of different lengths as they may be encountered from job-to-job. When the bridge 88 is adjusted in its upstream or downstream position, the stop means 85 are similarly adjusted so as to provide greater or lesser spacing from the rear retainer 89 on the stop surface 20.

5. Resume and Spatial Relationships

In review, the present invention is practiced by providing means for forming a vertical queue stack of documents, and successively clutching to the tail portions of lowest, non-moving documents in the stack—to strip out documents in succession and in staggered (shingled) relation.

The queue stack is preferably kept "live", i.e., documents are added to the top at an average rate which equals the constant rate at which they are clutched and pulled out from the bottom of the stack by the vacuum belt B4. This constant rate (documents per minute) is proportional to the lineal speed of the vacuum clutch belt B4 (which is adjustable by setting the speed of the motor 74) and inversely proportional to the spacing S between successive rows of holes 105 therein. In this fashion, the queue stack weight (i.e., its height) can be kept low and essentially constant so that sliding frictional forces are both low and consistent.

A receiving conveyor 21 (or the processing device itself) is driven at the same lineal speed as the clutch belt B4, so that the latter, for the sake of economy, need not be of undue length.

One key to the success of the invention resides in the arrangement by which successive documents are clutched, near their "tails" or upstream ends, to discrete locations or regions that are equally spaced apart longitudinally (by the chosen distance S) of the belt B4 or other equivalent conveyor means. A second key factor is the formation of the channels 93 in the support surface 20 at locations transversely spaced from (and preferably straddling) the belt B4, together with rounded tips (FIG. 11A) which cam the leading edge of the most recently clutched document downwardly so that it moves through the "gate" while the next-higher signature in the stack is abutted against and retained by the tapered tube tip (FIG. 11). As here described, the clutching action to one document occurs each time that a row of holes reaches the upstream ends of the slots 106, and thus the just-previously uncovered lower surface at the tail portion of the lowest non-moving document in the stack is at that instant sucked into driving engagement with the moving belt. Since the spacing S for the holes 105 is less than the length L of the documents being handled, a given document at the bottom of the stack is started forwardly before the preceding document or documents have been pushed wholly beyond the leading edge of the given document. This produces the overlapped or shingled relation of the successive documents.

Figure 23:
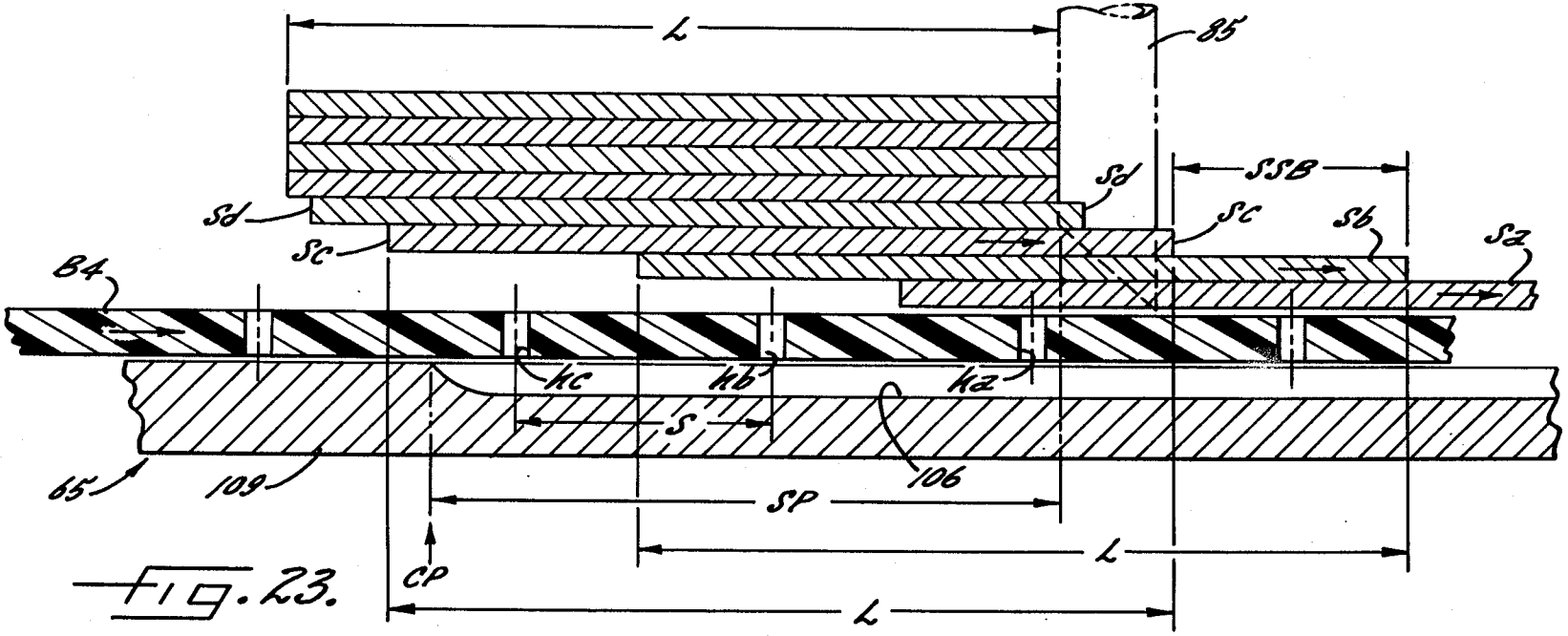
FIG. 23 is a diagrammatic, idealized illustration of spatial relationships associated with a queue stack locating stop and vacuum grooves which locate a clutching point, as they are determined from documents of a given length and the selected setback SSB.

Certain spatial relationships may be better understood by reference to the diagrammatic and idealized stop-motion illustration in FIG. 23, where the bend-down of signatures is not shown in the interest of clarity. Signatures $s_a$, and $s_b$ are shown moving forwardly;

the signature $s_c$, with its leading edge set back the distance SSB from signature $s_b$, has just begun moving, and its leading edge has just moved through the gate (i.e., beyond the tip of tube 85); and the signature $s_d$ has its leading edge just at the lower tip of the stop member 85. The length L of each signature is fixed for a given job, and the setback SSB is chosen and determined by (made equal to) the spacing S between successive rows of holes in the belt B4. The tail portions of $s_a$, $s_b$, $s_c$ are clutched to and driven by the belt due to vacuum applied from slots 106 through the respective holes $h_a$, $h_b$, $h_c$.

The upstream end of the slots 106 is designated as the clutch point CP and lies upstream of the stop 85 by a spacing SP.

From this diagrammatic illustration, it may be seen that at the instant when the leading edge of a given signature has moved forwardly through the channel 93 and beyond the tube tip **85*b* by a distance SSB, then the undersurface of the next signature is exposed for direct contact with the belt B4** in a "tail" region which in dimensional length is equal to SSB. The clutch point CP must be located within (under) that tail region, and preferably in the longitudinal middle of that region.

Thus, for given values of L and SSB (with S=SSB), one adjusts the bridge 88 and stop tubes 85 along the path such as to make $$SP<L \quad (1)$$

but $$SP>L-SSB \quad (2)$$

More specifically, relationships (1) and (2) may be satisfied if $$SP=L-1/k \cdot SSB \quad (3)$$

where 1/k is a selected or chosen fraction. Usually a fraction of ½ is most satisfactory, and in the preferred form, the spacing is made:

$$SP=L-(SSB/2 \quad (4)$$

so that the clutch point CP is located in the middle of the exposed "tail" of a given signature at the instant such signature is clutched to the belt.

As noted above and as seen in FIG. 11 and 11A, the lower ends of the stop members or tubes are tapered (FIG. 11) and rounded (FIG. 11A). They are either flush with or slightly below the support surface 20; in the latter case they project slightly down into the channels 93. The tube tips and the channels form a gate through which the leading edge of a signature is cammed downwardly with a dimpling action as forward drive begins by action of the vacuum holes at the tail region of that signature. The airstream lubrication (FIG. 11) not only reduces friction between the signature which has just begun moving and the next-higher signature (s3 and s4 in FIG. 11), but also holds the leading edge of such next-higher signature up so that it is retained against forward motion by the inclined surface of the tube tip. Yet, it is in a position to be cammed downwardly as a consequence of clutching action when the next row of holes reaches the slots 106 and pulls the tail region of that signature down into driven relation with the belt B4.

The present invention creates a reliably uniform running shingle 11 from a queue stack, the shingle velocity being as high as about 550 f.p.m. Assuming as an example for purposes of discussion (based on one physical embodiment of the invention) that signatures twelve inchss in length are formed into the shingle 11 with a five inch setback, when the shingle is running at a velocity of 500 f.p.m., the rate of signature through-put is 72,000 per hour. A signature is clutched successfully to the belt B4 every fifty milliseconds! To the extent of applicant's personal knowledge, this is several times faster than anything available in the commercial marketplace for forming a running shingle from pre-stored signatures. It permits extremely fast processing devices to be used and kept busy when pre-stored or randomly received signatures are to be fed into such devices.

I claim:

1. In a machine to convert preformed and stored documents into an essentially uniform, running shingle for feeding into a processing device, the combination comprising (a) first conveyor means, onto which documents are placed in a rough shingle, for transporting such documents downstream to a holding location, (b) a support surface defining the holding location generally at the downstream end of said first conveyor, said surface being located with vertical spacing below said first conveyor and having a longitudinal cut-out region, (c) stop means at the downstream end of said first conveyor engaged by the leading edges of documents in said rough shingle to make them accumulate in a generally vertical queue stack resting on said support surface, (d) said stop means being generally perpendicular to said support surface and overlying at least one channel formed in the support surface to define a camming gate, (e) second conveyor means running in the same direction as the first, extending downstream beyond said camming gate, and disposed in said cut-out region of said support surface to be substantially co-planar therewith, and (f) means associated with said second conveyor means for affirmatively clutching to the tail portion of the lowest stationary document in the stack after and because such tail portion is exposed by movement of the preceding document and thus for pushing documents seriatim from said stack to run through said gate with the second conveyor means and in uniformly shingled relation downstream of said gate.

2. The combination set forth in claim 1, wherein said documents are of length L and said means (f) includes (f1) means on and spaced by a predetermined distance S lengthwise of said second conveyor for clutching to the tail portions of successive documents at the bottom of said stack, said distance S being less than the length L, each document being clutched to said second conveyor before the previously clutch document has cleared the stack.

3. The combination set forth in claim 1 further characterized in that said second conveyor means includes a flat belt disposed in interdigital relation to said first conveyor means.

4. The combination set forth in claim 2, further characterised in that said second conveyor means includes a driven flat belt with its upper flight running in a downstream direction and disposed essentially co-planar with or just below said support surface, and said clutching means (f1) includes means for applying vacuum suction through separate, discrete regions longitudinally spaced by said distance S along said belt to clutch the contiguous under surface of a document, the vacuum suction being applied through each such region as it travels downstream from a first point CP located with predetermined spacing SP upstream from said stop means.

5. The combination set forth in claim 1 further characterized in that the lower region of said stop means is tapered in a downstream direction, whereby the leading edge of the lowest document in said stack is dimpled and cammed down into said channel for travel through the gate when its tail region is clutched to and pushed by said second conveyor.

6. The combination set forth in claim 5 further including (g) means for flowing an air stream inwardly between (i) the document whose leading edge has started through the gate and the next higher document in said stack.

7. The combination set forth in claim 4 further characterized in that the documents being carried on said first conveyor means to said stack are of length L in the direction of travel, said separate regions are longitudinally and uniformly spaced along said belt by said distance S so that the documents clutched by vacuum suction are pushed from the stack with a shingle setback SSB, equal to S, and wherein said predetermined spacing SP is less than L but greater than L−SSB.

8. The combination set forth in claim 7 further characterized in that said predetermined spacing SP is approximately equal to L−(SSB/2).

9. The combination set forth in claim 7 further characterized in that said separate regions are transverse rows of holes in said belt and said means for applying vacuum suction includes a vacuum shoe over which said belt runs, said shoe having longitudinal slots with which the holes of a row register.

10. The combination set forth in claim 1 further including (g) means for varying the speed of said first conveyor means so as to maintain the weight of said queue stack approximately constant.

11. The combination set forth in claim 1 further including (g) means to control the height of said queue stack formed by documents incoming from said first conveyor means, so that the top of the stack is at least slightly below the plane of such first conveyor means, and (h) means to impart bowing of the rough shingle in its transverse medial region as it exits from the first conveyor means, thereby to stiffen the rough shingle and aid in travel of the document leading edges into abutment against said stop means.

12. The combination set forth in claim 1 further including (g) means for directing a stream or air in an upstream direction between the document most recently clutched and being pushed from the bottom of said stack and the document next-to-be-pushed from the bottom of the stack, thereby to lessen friction as the first such document moves relative to the second.

13. The combination set forth in claim 1 further including (g) means, located downstream of said stop means, for riding on and downwardly biasing the shingle of documents running on said second conveyor means, thereby to inhibit upward curling of the leading edges of such documents.

14. In a machine to convert a stack of individual documents into a running shingle traveling along a longitudinal path for feeding into a processing device, the combination comprising (a) a substantially planar support surface straddling the centerline region of said path and having longitudinal channels on opposite sides of such centerline region, (b) an endless conveyor belt and means for driving the same so that one flight thereof runs in a downstream direction along said path, said one flight being straddled by said support surface and lying essentially in or just below the plane of such surface, (c) a vacuum shoe supported with its upper surface underlying said one flight and formed with a plurality of slots extending in the direction of said path but spaced apart transversely of the path, (d) said belt having a plurality of rows of transversely spaced openings therethrough, the openings within each row being spaced apart to register with respective ones of said slots, and said rows being separated from one another longitudinally along the belt by a predetermined distance S which is less than the length of one document but substantially equal to the desired setback SSB of the running shingle to be created, (e) means for creating a vacuum in said shoe so that air tends to be sucked in through the belt openings which are in registry with said slots as the belt is moving, and (f) means for forming a stop barrier extending substantially perpendicular to said support surface but opposite said longitudinal channels in such surface, the tip of the stop barrier means being approximately alined with said support surface to create a camming gate which cams passing documents downwardly with dimpling action, whereby when a stack of documents is present on said support surface with leading edges of the upper documents against said barrier, the tail regions of lowermost documents are affirmatively clutched individually in succession to said one belt flight and pushed out through said gate to run in shingled relation with the belt.

15. The combination set forth in claim 14 further including (g) means for supplying additional documents to the top of a stack which is present on said support surface so as to maintain the stack weight at least approximately constant as successive documents are pushed out from the bottom of the stack.

16. The combination set forth by claim 15 wherein said means (g) includes (g1) a driven conveyor located near the upstream end of said belt and said support surface for feeding documents onto the top of a stack resting on such surface, (g2) means for sensing and signaling the height of such stack, and (g3) means responsive to signals from said means (g2) for increasing or decreasing the speed of said conveyor (g1) when the stack height becomes lesser or greater than a predetermined, desired height.

17. The combination set forth by claim 16 wherein said means (g2) is a photoelelctric stack height sensing means.

18. The combination set forth in claim 14 further including (g) means for blowing air inwardly toward the leading edges of documents near the bottom of a stack in the region of said gate, thereby to lessen friction between adjacent documents as the lowest one is successively clutched and pushed out of the stack.

19. The combination set forth by claim 18, wherein said means (g) includes at least one air nozzle on or in the lower end of said stop barrier, the nozzle being aimed to direct air in an upstream direction between the leading edge of the document next to be clutched and the document just previously clutched to said belt, and means for blowing air through said nozzle.

20. The combination set forth by claim 19 further characterized in that said stop barrier is constituted by a plurality of air tubes disposed generally in perpendicular relation to said support surface, the lower lips of said air tubes being essentially at the level of said support surface or projecting slightly into said channels, and air nozzles in the ends of said tubes to blow air toward ther leading edge of the lowermost stationary document in the stack.

21. The combination set forth in claim 14 further including (g) means, located downstream of said gate and under which the continuous shingle runs, for holding the shingled documents down as they continue to travel after being clutched.

22. The combination set forth by claim 21 further characterized in that said means (g) is constituted by a plurality of rollers rotatable about an axis transverse to said path and biased downwardly toward and into engagement with the shingle running with and on said belt, said rollers tucking down and reducing any upward curl of the leading edges of the documents in the shingle.

23. The combination set forth in claim 14 further including (g) means for pneumatically lubricating the relatively moving surfaces constituted by (i) the stationary upper surface of said vacuum shoe and (ii) the under surface of said one flight of the belt.

24. The combination set forth by claim 23 further characterized in that said means (g) is comprised of a plurality of longitudinal troughs in the otherwise smooth upper surface of said vacuum shoe, the forward travel of said belt flight pulling air into the grooves and pumping it between said stationary upper surface and said under surface, whereby such surfaces move relatively with a thin air layer between them and without substantial generation of heat due to rubbing friction.

25. The combination set forth in claim 14 further including (g) belt means constituting a receiving conveyor disposed downstream of said conveyor belt (b) and in part straddling the downstream end portion of said one flight in a region downstream of said slots, (g1) the upstream end of said belt means being spaced downstream of said slots by a distance which is less than the length of each document.

26. The combination set forth in claim 25 further characterized by means for driving said receiving conveyor belt means at a lineal speed which is substantially equal to the lineal speed of said conveyor belt (b), whereby said receiving conveyor carries the running shingle onwardly beyond the belt (b).

27. The combination set forth in claim 14 further characterized in that said one flight of said belt (b) extends in an upstream direction beyond the upstream edge of said support surface (a), and further including (g) an infeed conveyor located upstream of said belt (b) and adapted to transport rough-singled documents to a stack on said support surface (a) and up against said barrier (f), said infeed conveyor including (g1) two outer and one inner belt flights and means driving them in a downstream direction toward said support surface (a).

(g2) said two outer belt flights leading substantially to the upstream edge of said support surface (a), and having their downstream end portions straddling the upstream end portion of said one belt flight, (g3) said inner belt flight leading downstream substantially to the upstream end of said belt (b) but a location upstream of said support surface, and (g4) said outer and inner belt flights having their upper surfaces disposed in a plane lying with vertical spacing above said support surface, whereby documents flowing downstream on the infeed conveyor are piled seriatim on the top of a stack disposed on said support surface but with said belt (b) running under or in sliding contact with the lowermost document until the latter is clutched to that belt.

28. The combination set forth in claim 27 further including (h) means disposed above the upstream end portion of said one belt (b) to impart a downward bowing to documents as they depart from said inner belt flight, thereby to stiffen each document so that it continues downstream until its leading edge engages said stop barrier (f).

29. The combination set forth in claim 28 wherein said means (h) includes at least one soft friction wheel rotatable about an axis transverse to said path, said wheel being biased downwardly and rolling in contact with the transverse medial regions of documents as they exit from contact with said inner belt flight.

30. In a machine to convert a stack of individual documents, each having a nominal length L, into a running shingle for transport into a processing device, the combination comprising (a) a table surface having a central gap extending longitudinally in the direction of shingle travel, (b) an endless conveyor belt having one flight in said gap and in or just below the plane of said table surface and movable in said direction, (c) means for driving said belt to make said one flight run in said direction of travel, (d) a vacuum shoe disposed beneath said one flight and formed with a plurality of slots extending in said direction and spaced apart transversely of said direction, (e) said belt having a plurality of transverse rows of transversely spaced openings therethrough, the openings within each row being spaced transversely apart to register with respective ones of said slots, and said rows being spaced longitudinally along the belt by a predetermined distance S which is less than the length L but is sustantially equal to the setback SSB of the running shingle to be created, (f) means for creating a vacuum in said shoe so that air tends to be drawn through the belt openings which are in registry with said slots as the belt is moving, and (g) a stop member extending generally perpendicular to said table surface but overlying a channel defined in such surface and extending in said direction to form a camming gate which cams passing documents downwardly with dimpling action, whereby when a stack documents is supported on said table surface, the tail regions of lowermost documents are affirmatively clutched by vacuum action in succession to said one flight and pushed out through said gate to run in shingled relation with the belt, the shingle setback SSB of document leading edges being generally equal to said predetermined distance S.

31. The combination set forth in claim 30 further characterized in that the lower end of said stop member is rounded and essentially flush with said table surface, so as to form a dimple by depression of a passing document into said channel.

32. The combination set forth in claim 30 further characterized in that the lower end of said stop member is tapered downwardly in the direction said one flight runs, whereby the leading edge of a document clutched to said belt is bowed or dimpled to pass under such lower end.

33. In apparatus for feeding documents sequentially from a stack along a path, the combination comprising (a) a planar support surface upon which said stack is placed and supported, (b) barrier means disposed generally perpendicular to said support surface and engageable by the leading edges of documents in the stack to locate their position lengthwise of the path and to prevent their movement along the path, the support surface extending both upstream and downstream from said barrier means, (c) at least one driven belt having an upper flight located in or slightly below the plane of said support surface and running the direction of said path, said upper flight underlying a portion of the bottom area of said stack and being offset laterally of the path from said barrier means, and said upper flight extending both upstream and downstream from said barrier means, (d) said barrier means having at least one lower tip vertically registered with a relieved channel in said support surface, said channel extending both upstream and downstream from said lower tip, and said lower tip being essentially at or slightly below the plane of said support surface, (e) means for successively clutching the tail region of the lowest, non-moving document in said stack to said belt, thereby to push that document along the path so that its leading edge is dimpled by said lower tip and the document passes beneath said lower tip to run with said belt, (e1) said barrier means and its lower tip together with said channel constituting camming gate means for preventing the next-lowest non-clutched document in the stack from moving downstream with the last-clutched, moving document.

34. The combination set forth in claim 33, further including means for blowing air in a generally upstream direction between the most-recently clutched document and the leading edge of the next-lowest, non-moving document in the stack.

35. The combination set forth in claim 33 further including means for maintaining the weight of a stack on said support surface at least approximately constant.

36. The combination set forth in claim 33 wherein said lower tip is tapered downwardly in a downstream direction, thereby to said in camming the leading edge of a clutched document down and under the tip.

37. The combination set forth in claim 33 wherein said lower tip is transversely narrower than said channel and is rounded in a transverse direction, thereby to aid in creating a longitudinal dimple in a document being pushed beneath the tip.

38. In a machine adapted to successively strip articles from the bottom of a vertical stack for transport seriatim along a path, the combination comprising (a) a flat belt drive with its upper flight running along said path and beneath said stack, (b) a vacuum shoe having a generally flat upper surface beneath said upper flight, (c) means including said vacuum shoe for successively attracting by suction the lowermost article in said stack into driven engagement with said belt, and therefore undesirably attracting said upper flight into rubbing engagement with said upper surface, and (d) means including irregularities in said upper surface for creating a lubricating film of air between said upper surface and upper flight to alleviate frictionally generated heat and rubbing wear on the belt.

39. The combination set forth in claim 38 further characterized in that said means (d) comprises a plurality of troughs formed in said upper surface and extending lengthwise along the path, each trough having an open mouth at the upstream end of said surface but restricted or closed at a point short of the downstream end of said surface.

40. In apparatus for transforming a stack of documents into a running shingle moving along a path, the combination comprising, (a) means for supporting the stack and restraining the documents therein from movement in a direction downstream of the path, (b) said means (a) including, however, means defining a gate which permits the leading edge of the lowermost non-moving document in the stack to be started in motion downstream and which permits a plurality of documents to be passing simultaneously through the gate, (c) conveyor means underlying said stack and continuously running in a downstream direction beyond said gate, (d) means associated with said conveyor means for affirmatively clutching to the tail portion of the lowest stationary document in the stack, after and because such tail portion is exposed to the conveyor by downstream movement of the preceding document, to push documents successively downstream through said gate and in uniformly shingled relation, (e) said means (d) including clutching means uniformly spaced lengthwise of the conveyor by a predetermined distance S which determines the running shingle setback SSB and makes the latter equal to S, and (b1) said gate means including camming means for deforming the documents being pushed therethrough into a running dimpled configuration, whereby the gate means prevents the lowest, non-clutched document in the stack from moving despite sliding frictional engagement with the most-recently clutched ad moving document.

41. In apparatus for transforming a stack of documents into a running shingle moving along a path, the combination comprising (a) an endless conveyor belt and means for driving the same so that one flight thereof runs in a downstream direction along said path, (b) means for supporting the document stack with the undersurface of the lowermost non-moving document closely juxtaposed to or in rubbing contact with said one flight of said belt, the stacked documents lying in an essentially flat configuration, (c) barrier means at the downstream edges of the documents in the stack and defining a gate for permitting the leading edge of the lowermost non-moving document to be started in motion downstream through such gate, (d) said belt being formed to include discrete air-permeable regions which are spaced apart longitudinally along the belt by a predetermined distance S and which are separated by intervening non-permeable regions, and (e) means including a vacuum shoe underlying said one flight for drawing suction through those of said air-permeable regions which are located in said one flight and overlie the shoe, whereby the tail portion of the lowest non-moving document is affirmatively clutched by vacuum attraction through one of said permeable regions to said belt without significant downward bending of such tail portion from its flat configuration and that document's leading edge is pushed downstream through said gate ony after the tail portion of the previously clutched and moving document has traveled downstream a distance S, so that an overlapped plurality of documents moves continuously through said gate in shingled relation with their leading edges spaced by a setback SSB which is substantially equal to said predetermined distance S, the motion imparted to each given document being initiated primarily by pushing on the undersurface of its tail portion due to vacuum clutching through one of said air-permeable regions of said belt, the undersurface portion of the given document forward of the tail portion being masked from vacuum clutching to the preceding air-permeable region of said belt by the intervening tail portions of the preceding documents.

42. The invention defined by claim 41 further characterized in that (i) said documents are of nominal length L, (ii) said one flight of said belt extends from a location upstream of said gate to a location downstream of said gate, (iii) said vacuum shoe effectively extends from a location CP upstream of said gate by a distance SP and extends to a location downstream of said gate, and (iv) said distance SP is less than said length L but greater than L−SSB, where SSB is the desired setback of the running shingle which is determined by and equal to said predetermined distance S between said air-permeable regions.

43. The invention defined by claim 41 further characterized in that said air-permeable regions in said belt are rows of holes, the rows extending transversely across the belt and being spaced by said distance S longitudinally along the belt.

44. The method of creating a running shingle from a stack of documents, said method comprising (a) supporting the stack of documents in overlying relation to a conveyor which moves continuously in a downstream direction along a path, (b) restraining the leading edges of the documents in the stack against motion in a downstream direction except for a gate of predetermined height which permits the combined thickness of a selected plurality of documents to pass through in a downstream direction, (c) affirmativley clutching, by application of vacuum, the undersurface of the tail portion of the lowest non-moving document in the stack to said conveyor to push its leading edge through said gate, said clutching being timed to occur at an instant when the preceding clutched document—that formerly was the lowest non-moving document—has been pushed by said conveyor a predetermined distance S which is less than the length L of the documents and which is equal to the setback SSB thus created in a lapped shingle exiting continuously from said gate on said conveyor, and (b1) causing the lowest, non-clutch document in the stack to be restrained from downstream movement, despite sliding friction between it and the preceding clutched document which is moving, by arranging said gate to cam the moving documents into a running dimple configuration as a consequence of their propulsion by the conveyor to which they are clutched.

45. The method set forth in claim 44 further characterized in that the timing of said clutching at said instant is accomplished by clutching the tail portions of successive lowest non-moving documents to respective successive regions of the conveyor which are longitudinally spaced by said predetermined distance S, each clutching action being initiated when one of said region is passing a predetermined point CP located beneath the tail regions of documents in the stack.

46. The method set forth by claim 45 further characterized in that said predetermined point CP is spaced upstream from the leading edges of documents in the stack by a distance SP which is less than the document length L but greater than L−SSB, where SSB is the shingle setback and equal to S.

* * * * *